US009816715B2

(12) United States Patent
Morikawa et al.

(10) Patent No.: US 9,816,715 B2
(45) Date of Patent: Nov. 14, 2017

(54) HUMIDIFIER AND AIR-CONDITIONING APPARATUS WITH HUMIDIFIER

(71) Applicants: Akira Morikawa, Chiyoda-ku (JP); Takahiro Sakai, Chiyoda-ku (JP); Yasutaka Inanaga, Chiyoda-ku (JP); Hiroshi Tsutsumi, Chiyoda-ku (JP); Masaru Takada, Chiyoda-ku (JP)

(72) Inventors: Akira Morikawa, Chiyoda-ku (JP); Takahiro Sakai, Chiyoda-ku (JP); Yasutaka Inanaga, Chiyoda-ku (JP); Hiroshi Tsutsumi, Chiyoda-ku (JP); Masaru Takada, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 152 days.

(21) Appl. No.: 14/417,470

(22) PCT Filed: Feb. 25, 2013

(86) PCT No.: PCT/JP2013/054731
§ 371 (c)(1),
(2) Date: Jan. 26, 2015

(87) PCT Pub. No.: WO2014/045609
PCT Pub. Date: Mar. 27, 2014

(65) Prior Publication Data

US 2015/0219346 A1 Aug. 6, 2015

(30) Foreign Application Priority Data

Sep. 18, 2012 (JP) ..... 2012-204713

(51) Int. Cl.
*F24F 6/02* (2006.01)
*F24F 3/14* (2006.01)
(Continued)

(52) U.S. Cl.
CPC ..... *F24F 6/02* (2013.01); *F24F 1/0007* (2013.01); *F24F 3/14* (2013.01); *F24F 6/04* (2013.01);
(Continued)

(58) Field of Classification Search
CPC ..... F24F 6/04; F24F 2006/046; F24F 6/08; F24D 19/0082
See application file for complete search history.

(56) References Cited

U.S. PATENT DOCUMENTS 654,725 A * 7/1900 Gardner ..... F24F 6/04 261/103
684,217 A * 10/1901 Gardner et al. ..... F24F 6/04 261/103
(Continued)

FOREIGN PATENT DOCUMENTS

AU EP 2636963 A2 * 9/2013 ..... F24F 5/0035
CH 667514 A5 * 10/1988 ..... B65D 81/22
(Continued)

OTHER PUBLICATIONS

Phoenix Translations translation of Ichiro Kawashima et al. JPH01178539 published Dec. 21, 1989.*
(Continued)

*Primary Examiner* — Amber R Orlando
*Assistant Examiner* — Stephen Hobson
(74) *Attorney, Agent, or Firm* — Oblon, McClelland, Maier & Neustadt, L.L.P.

(57) ABSTRACT

A humidifier that suppresses formation of a slime, a scale, and a dew bridge in a lower portion of a humidifying member thereby preventing degradation in humidifying performance. The humidifier includes one or more porous metal bodies serving as the humidifying member and including therein a plurality of voids, a fan that blows air to the porous
(Continued)

metal body, a water-supplying device (a supply pipe, a reservoir, and a nozzle) that supplies water to the porous metal body, and the porous metal body includes a tip portion formed in a lower end portion, in a protruding shape or a pointed shape.

9 Claims, 21 Drawing Sheets

(51) Int. Cl.

| | |
|---|---|
| ***F24F 1/00*** | (2011.01) |
| *F24F 3/147* | (2006.01) |
| *F24F 6/10* | (2006.01) |
| *F24F 6/08* | (2006.01) |
| *F24F 6/04* | (2006.01) |

(52) U.S. Cl.
CPC ..... *F24F 3/147* (2013.01); *F24F 6/025* (2013.01); *F24F 6/08* (2013.01); *F24F 6/10* (2013.01); *F24F 2006/046* (2013.01); *Y10S 261/15* (2013.01); *Y10S 261/41* (2013.01)

(56) References Cited

U.S. PATENT DOCUMENTS 1,283,950 A * 11/1918 Stiefel ..... F24F 6/04 261/103
1,903,250 A * 3/1933 Tenney ..... F24F 6/04 165/116
1,965,255 A * 7/1934 Peabody ..... F24F 6/04 261/103
2,099,009 A * 11/1937 Finley ..... F24D 19/0082 160/44
2,161,834 A * 6/1939 Seeley ..... F24D 19/0082 237/78 R
2,204,016 A * 6/1940 Karlson ..... F24F 3/14 165/223
2,251,734 A * 8/1941 Fuld ..... E03D 9/04 239/41
2,326,089 A * 8/1943 Wittman ..... F24D 19/0082 126/113
3,378,238 A * 4/1968 Babington ..... F24F 6/04 126/113
3,523,681 A * 8/1970 Jaye ..... F24F 6/04 261/142
3,722,838 A * 3/1973 Swimmer ..... F24F 6/04 220/4.21
3,748,828 A * 7/1973 Lefebvre ..... B01D 1/14 210/635
4,389,352 A * 6/1983 Bohanon, Sr. ..... F24F 6/04 261/106
5,226,935 A * 7/1993 Wolff ..... B05B 17/085 239/193
5,624,610 A * 4/1997 Yokoya ..... F24F 3/1417 134/3
6,474,628 B1 * 11/2002 Stroh ..... F24F 6/04 261/107
6,550,748 B2 * 4/2003 Stanek ..... F24F 6/00 261/105
6,669,626 B1 * 12/2003 McDonough ..... A61G 11/00 600/22
9,555,198 B2 * 1/2017 Yang ..... A01M 1/2077
2003/0137064 A1 * 7/2003 Stanek ..... F24F 6/00 261/100
2005/0133942 A1 * 6/2005 Schuld ..... F24F 6/043 261/106
2006/0162368 A1 * 7/2006 Boland ..... A45B 3/00 62/310
2007/0257384 A1 * 11/2007 Sung ..... C10J 1/24 261/119.1
2008/0152973 A1 * 6/2008 Mogi ..... H01M 8/04291 429/413
2009/0000620 A1 * 1/2009 Virr ..... A61M 16/1075 128/203.27
2010/0207286 A1 * 8/2010 Jursich ..... F24F 6/043 261/102
2010/0313580 A1 * 12/2010 Morioka ..... B05B 5/057 62/78
2012/0267804 A1 * 10/2012 Rodrigs ..... F24F 6/04 261/64.1
2013/0106004 A1 * 5/2013 Stumphauzer ..... F24F 6/04 261/128
2013/0186611 A1 * 7/2013 Schneider ..... F24F 11/0008 165/226
2013/0213076 A1 * 8/2013 Gerlach ..... F24F 13/15 62/314
2013/0284169 A1 * 10/2013 Foote ..... A61M 16/1075 128/203.14
2013/0313729 A1 * 11/2013 Sakai ..... F24F 6/025 261/130
2015/0153052 A1 * 6/2015 Saito ..... F24F 11/0008 261/128
2015/0219346 A1 * 8/2015 Morikawa ..... F24F 3/14 261/136
2016/0040897 A1 * 2/2016 Sakai ..... F24F 13/08 261/101
2016/0146483 A1 * 5/2016 Sakai ..... F24F 6/04 62/176.4
2016/0251521 A1 * 9/2016 Izutani ..... C09D 1/00 261/101

FOREIGN PATENT DOCUMENTS

GB 1121161 A * 7/1968 ..... F24F 6/04
JP 56-36028 U 4/1981
JP 62-175537 A 8/1987
JP 1 178539 12/1989
JP H01178539 * 12/1989
JP 2 192528 7/1990
JP 4 143536 5/1992
JP 4 363528 12/1992
JP 6 84230 12/1994
JP 7 107457 11/1995
JP 7 305883 11/1995
JP 8 30594 3/1996
JP 2005 201507 7/2005
JP 2006 10135 1/2006
JP 2007 278576 10/2007
JP 2011 185501 9/2011
JP WO 2012073386 A1 * 6/2012 ..... B01D 53/261
JP WO 2014129027 A1 * 8/2014 ..... F24F 6/04

OTHER PUBLICATIONS

Notice of Reasons for Rejection dated Nov. 10, 2015 in Japanese Patent Application No. 2014-536615 (with English language translation).
International Search Report dated May 14, 2013 in PCT/JP13/054731 Filed Feb. 25, 2013.
Combined Chinese Office Action and Search Report dated Oct. 19, 2016 in Patent Application No. 201380048442.7 (with English Translation and English Translation of Category of Cited Documents).
Office Action dated May 15, 2017 in Chinese Patent Application No. 201380048442.7 (with English translation).

* cited by examiner

HUMIDIFIER AND AIR-CONDITIONING APPARATUS WITH HUMIDIFIER

TECHNICAL FIELD

The present invention relates to a humidifier and an air-conditioning apparatus including the humidifier.

BACKGROUND ART

With respect to specified designated buildings having a site area equal to or lager than 3000 [$m^2$], such as commercial facilities and offices, the Act on Maintenance of Sanitation in Buildings, generally known as building sanitation administration law, stipulates a control standard value for air environment as 17 [degrees C.] to 28 [degrees C.] for indoor temperature, and 40 [%] to 70 [%] for relative humidity. The indoor temperature has come to be relatively easily controlled, thanks to the spread of air conditioners. However, the relative humidity is not sufficiently controlled yet and, in particular, the lack of humidification in winter seasons is a major issue.

Humidification methods for an indoor space thus far known include vaporization, steaming, and spraying. The vaporization is performed by blowing air through a water-absorptive filter for heat exchange between the moisture contained in the filter and the air current, so as to evaporate the moisture from the filter thus humidifying the indoor space. In the steaming method, a heating device that heats up water in a tank is turned on to evaporate the water, thereby humidifying the indoor space. In the case of spraying, water is pressurized so as to turn into fine droplets, and the fine droplets of water exchange heat with air current.

For example, Patent Literature 1 proposes a humidifier based on the known vaporization method, the humidifier including a multitude of plate-shaped water-containing members vertically erected parallel to each other with a predetermined ventilation path therebetween, and located between an upper chamber and a lower chamber. The water-containing members according to Patent Literature 1 each have the upper edge fitted in a slit formed on the bottom plate of the upper chamber and including small holes formed on the respective sides, and the lower edge held by a groove provided in the lower chamber. Patent Literature 1 also teaches that a porous metal, a sintered metal, gathered metal fibers, gathered ceramic fibers, or other types of porous material may be employed as the water-containing member.

CITATION LIST

Patent Literature

Patent Literature 1: Japanese Examined Patent Application Publication No. 8-30594

SUMMARY OF INVENTION

Technical Problem

In the humidifier according to Patent Literature 1, however, when water is deposited around the lower end portion of the humidifying member, which is the plate-shaped water-containing member fitted in the groove of the chamber, germs and mold are prone to grow. When germs and mold grow a slime is formed, and the slime emits odorous substances thereby contaminating the air flowing out of the air outlet. In addition, the void of the porous metal body constituting the humidifying member may be clogged with the slime or scale, or dews may be deposited in the gaps between the humidifying members, which is known as bridging. In such cases the airflow is disturbed and the heat exchange efficiency declines, and consequently the humidifying performance is degraded.

The present invention has been accomplished in view of the foregoing problem, and provides a humidifier that suppresses formation of a slime, a scale, and a dew bridge around the lower portion of the humidifying member thereby preventing degradation in humidifying performance, and an air-conditioning apparatus including such a humidifier.

Solution to Problem

In an aspect, the present invention provides a humidifier that includes a humidifying member having therein a plurality of voids, a blower device that blows air to the humidifying member, and a water-supplying device that supplies water to the humidifying member. The humidifying member includes a projecting portion formed in a lower end portion and having a protruding shape or a pointed shape.

Advantageous Effects of Invention

The humidifier according to the present invention prevents deposition of water around the lower portion of the humidifying member. Therefore, the growth of germs or mold, as well as the formation of a dew bridge around the lower portion of the humidifying member can be suppressed, and the degradation in humidifying performance can be prevented.

DESCRIPTION OF EMBODIMENTS

Figure 1:
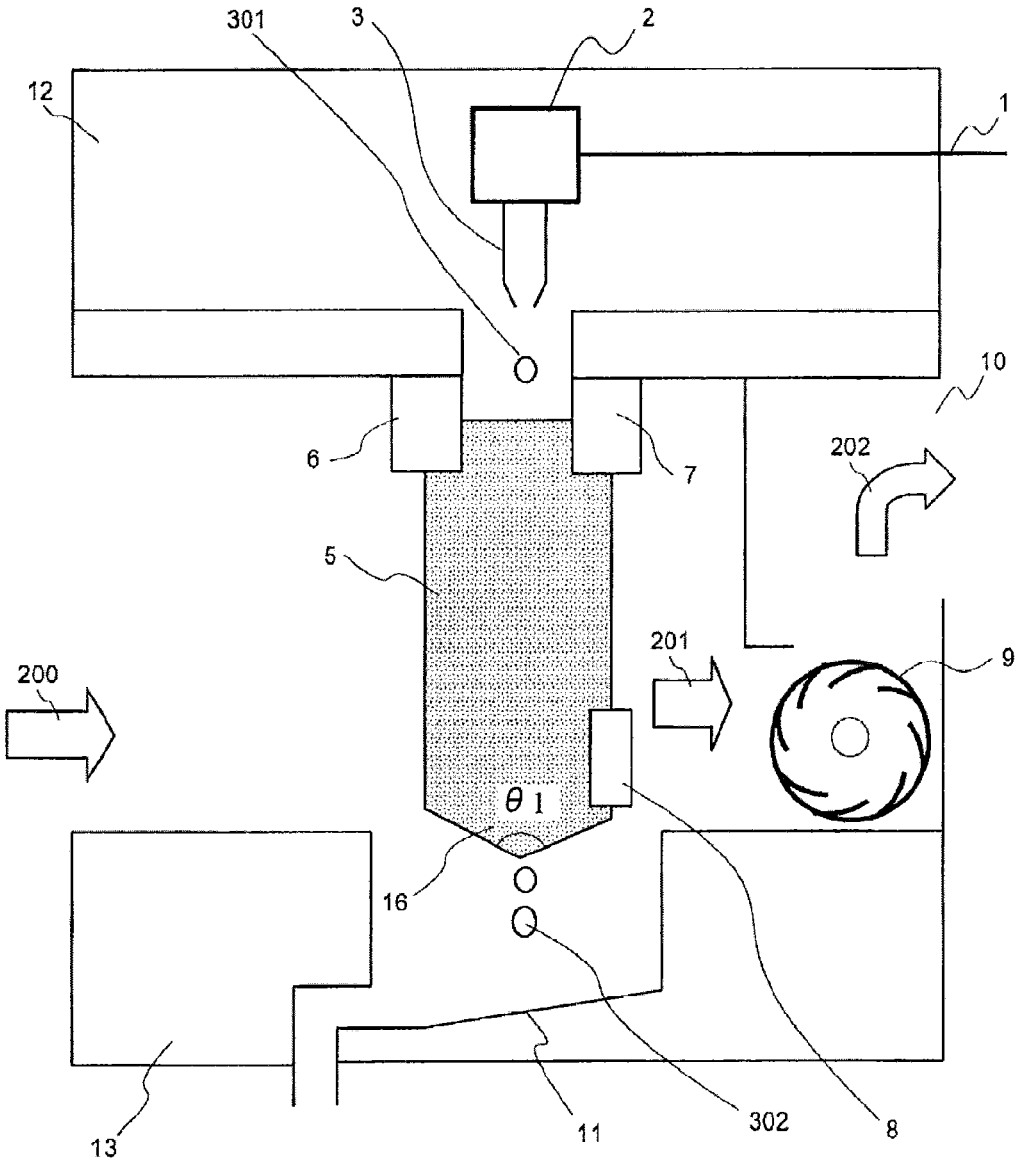
FIG. 1 is a drawing showing a configuration of a humidifier according to Embodiment 1 of the present invention.

Hereafter, Embodiments of the humidifier according to the present invention will be described with reference to the drawings. The illustrated shapes in the drawings are in no way intended to limit the scope of the present invention. In all the drawings, the same or corresponding constituents will be given the same numeral.

Embodiment 1

(General Configuration of Humidifier)

FIG. 1 is a schematic drawing showing a configuration of the humidifier according to Embodiment 1 of the present invention.

As shown in FIG. 1, the humidifier according to Embodiment 1 includes a supply pipe 1 for supplying humidifying water to a space to be humidified, a reservoir 2 for storing the humidifying water supplied through the supply pipe 1, a nozzle 3 for supplying downward the humidifying water in the reservoir 2 in the form of a water droplet 301, and a porous metal body 5 having therein a plurality of voids for retaining the humidifying water supplied from above, the porous metal body 5 exemplifying the humidifying member. The humidifier also includes an upper upstream support member 6 and an upper downstream support member 7 that each support the upper portion of the porous metal body 5, a lower support member 8 that supports the lower portion of the porous metal body 5, a fan 9 for causing air to pass through the porous metal body 5, the fan 9 exemplifying the blower device, and a drain pan 11 for receiving a water droplet 302 seeping out of the porous metal body 5 and discharging the water droplet 302 to outside. The upper upstream support member 6 and the upper downstream support member 7 are attached to a casing 12 in which the reservoir 2 and the nozzle 3 are accommodated. In addition, though not shown in FIG. 1, the lower support member 8 is connected to a casing 13 in which the drain pan 11 is accommodated, on the near side (left side in FIG. 1) and the deeper side (right side in FIG. 1) of the humidifier. An air outlet 10 for blowing out the humidified air is provided downstream of the fan 9.

In the subsequent description, the left side in FIG. 1 will be referred to as upstream side of airflow or near side, and the right side in FIG. 1 will be referred to as downstream side of airflow or deeper side, as the case may be.

The supply pipe 1, the reservoir 2, and the nozzle 3 constitute the water-supplying device for supplying the humidifying water to the porous metal body 5. The supply of the humidifying water to the porous metal body 5 by the water-supplying device is controlled by a non-illustrated controller.

The nozzle 3 is located right above the porous metal body 5, and serves to drop the humidifying water transported through the supply pipe 1, onto the top portion of the porous metal body 5. The nozzle 3 has a hollow shape, the outer and the inner diameter of which may be selected according to the size of the porous metal body 5. The tip portion of the nozzle 3 may be of a triangular conical shape, a circular tube shape, or a square tube shape, among which the triangular conical shape is adopted and the outlet of the nozzle 3 has a bore diameter of 0.5 [mm], in Embodiment 1. Forming the tip portion in an acute angle facilitates the dews to be separated from the nozzle 3. It is preferable to form the tip portion in a more acute angle. However, forming the tip portion in an excessively acute angle makes the nozzle 3 difficult to handle and degrades the strength thereof, and a preferable range of the angle of the tip portion is 10 degrees to 45 degrees. When the outlet is too large an excessive amount of water is supplied and wasted, while when the outlet is too small the nozzle 3 is prone to be clogged with particles and scales that have intruded in the water. From such viewpoints, a preferable range of the bore diameter of the outlet of the nozzle 3 is 0.3 [mm] to 0.7 [mm]. Examples of the material of the nozzle 3 include, but are not limited to metals such as stainless steel, tungsten, titanium, silver, or copper, and resins such as Teflon (registered trademark), polyethylene, or polypropylene.

The number of nozzles 3 may be determined according to the size of the porous metal body 5 in the airflow direction (length between the upstream end and the downstream end), such that a larger number of nozzles 3 are provided when the size of the porous metal body 5 in the airflow direction is larger, than when the size of the porous metal body 5 is smaller. For example, a single piece of nozzle 3 suffices when the size of the porous metal body 5 in the airflow direction is 60 [mm] or less, however it is preferable to provide a plurality of nozzles 3 when the size of the porous metal body 5 is larger than 60 [mm].

Although the amount of the humidifying water to be supplied to the porous metal body 5 through the nozzle 3 has to be larger than the amount actually consumed for the humidification, it can be wasteful to supply an excessively larger amount of water and it is preferable to determine an appropriate amount. For example, on the assumption that the humidifying capacity of the porous metal body 5 is 2000 [mL/h/m$^2$], the dimensions of the porous metal body 5 are 200 [mm] by 50 [mm], and the porous metal body 5 is configured so as to humidify from the both faces, the humidification amount per sheet of the porous metal body 5 is 40 [mL/h]. Accordingly, it is preferable to supply 60 [mL/h] to 200 [mL/h] of humidifying water to the porous metal body 5, which is 1.5 to 5 times of the humidification amount.

For the purpose of humidifying the space to be humidified, any of pure water, tap water, soft water, and hard water may be employed as the humidifying water, but, it is preferable to employ water containing less mineral components including calcium ion or magnesium ion, to prevent the void in the porous metal body 5 from being clogged with scales. This is because, when the humidifying water contains a larger amount of mineral components, the ion component and carbon dioxide are reacted with each other thereby generating solid matters, and the void in the porous metal body 5 becomes more likely to be clogged. Accordingly, the ion components may be removed from the humidifying water with an ion exchange film for positive ion and negative ion.

(Configuration of Porous Metal Body)

The porous metal body 5 is constituted of a porous metal having a three-dimensional mesh structure having therein a plurality of voids, and has a generally flat plate shape in Embodiment 1. The porous metal body 5 is mounted such that the flat surface is oriented generally parallel to the airflow and in a generally vertical direction. The porous metal body 5 according to Embodiment 1 has a pentagonal shape as shown in FIG. 1. More specifically, the upper edge of the porous metal body 5 is horizontal, and the lower end portion of the porous metal body 5 includes a tip portion 16 protruding downward in a pointed shape. The tip portion 16 corresponds to the projecting portion in the present invention. In Embodiment 1, the tip portion 16 is formed such that the pointed end is located on the center line of the porous metal body 5 in the depth direction. The interior angle of the tip portion 16 will be referred to as angle θ1. With the tip portion 16 thus formed, the cross-sectional area of the horizontal plane in the lower portion of the porous metal body 5 becomes steplessly smaller toward the lower position.

Here, the shape of the lower end portion of the porous metal body 5 is not limited to a linear slope, but may be of an arcuate shape for example.

Figure 2:
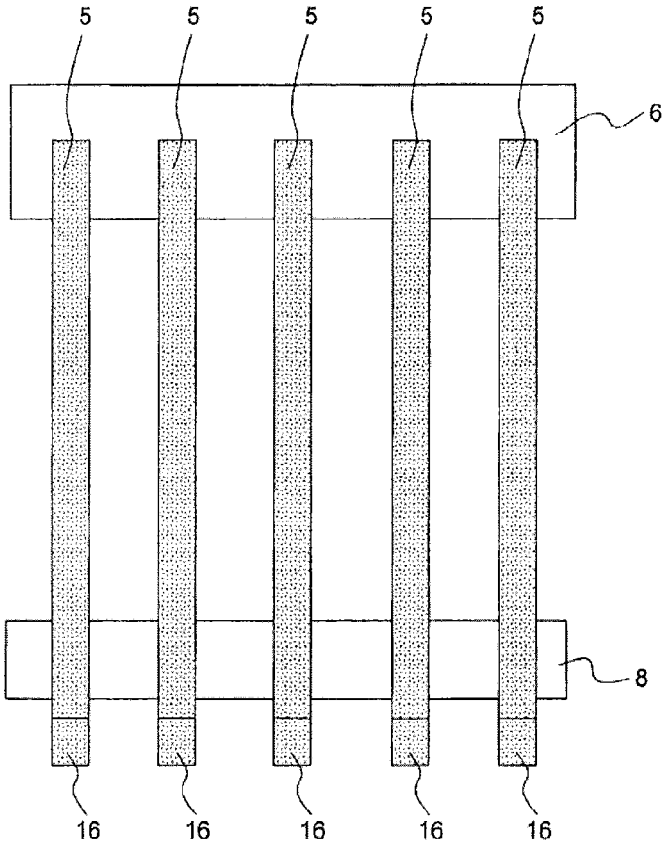
FIG. 2 is a drawing of a porous metal body 5 viewed from an upstream side of the humidifier according to Embodiment 1 of the present invention.

FIG. 2 is a drawing of a porous metal body 5 viewed from the upstream side of the humidifier according to Embodiment 1 of the present invention. FIG. 2 only illustrates the porous metal body 5, the upper upstream support member 6, and the lower support member 8. The humidifier according to Embodiment 1 includes a plurality of porous metal bodies 5, aligned with a predetermined gap therebetween with the respective flat surfaces oriented generally parallel to each other.

Here, it is not mandatory that the flat surface of the porous metal body 5 is oriented in the vertical direction, but the flat surface of the porous metal body 5 may be tilted with respect to the vertical direction.

Likewise, it is not mandatory that the respective flat surfaces of the plurality of porous metal bodies 5 are parallel to each other, but one or more of the porous metal bodies 5 may be inclined with respect to another.

Referring to FIG. 2, the upper upstream support member 6, the upper downstream support member 7, and the lower support member 8 constitute the humidifying member supporter in the present invention, and serve to support the porous metal body 5 with respect to the casings 12, 13. The upper upstream support member 6, the upper downstream support member 7, and the lower support member 8 also serve to maintain the gaps between the plurality of porous metal bodies 5 unchanged. The upper upstream support member 6, the upper downstream support member 7, and the lower support member 8 each include grooves in which a part of the porous metal bodies 5 is to be fitted.

Although FIG. 2 illustrates five pieces of porous metal bodies 5, the number of porous metal bodies 5 is not specifically limited, and one or more desired number of porous metal bodies may be provided. The upper upstream support member 6, the upper downstream support member 7, and the lower support member 8 may be formed of a desired material, provided that these members can be tightly combined with the porous metal bodies 5 into an integrated structure.

Figure 3:
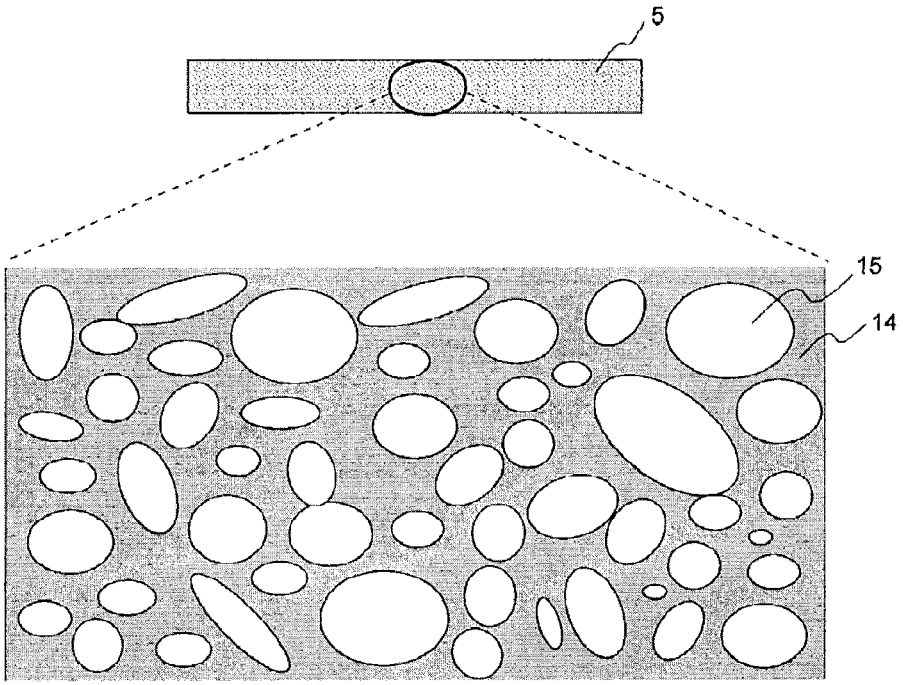
FIG. 3 is an enlarged partial cross-sectional view of the porous metal body 5 of the humidifier according to Embodiment 1 of the present invention.

FIG. 3 is an enlarged partial cross-sectional view of the porous metal body 5 of the humidifier according to Embodiment 1 of the present invention. FIG. 3 illustrates the three-dimensional mesh structure of the porous metal body 5. The porous metal body 5 has the three-dimensional mesh structure as shown in FIG. 3, which is similar to a sponge-like foamed resin. The porous metal body 5 is constituted of a metal portion 14 and a multitude of voids 15 formed in the metal portion 14.

The porous metal body 5 is widely employed for use in filters, catalyst carriers, gas diffusion layers of fuel cells, and so forth, and can be manufactured by a known method. The porous metal body may be formed, for example, by introducing bubbles in a slurry containing metal powder that is a material for forming the porous metal and a solvent, molding the slurry into a desired shape, and then sintering the slurry. Alternatively, a slurry containing metal powder that is a material for forming the porous metal, a binder resin to be decomposed through high-temperature sintering, and a solvent may be molded into a desired shape, and then degreased and sintered, to obtain the porous metal body.

The porous metal body 5 has a higher porosity and a larger average pore size than porous ceramics. Accordingly, the voids 15 in the porous metal body 5 can be prevented from being clogged with impurities contained in the humidifying water. In addition, the porous metal body 5 possesses capillary force, which enables the water droplet 301 from the reservoir 2 to be efficiently supplied into the porous metal body 5, without the need to employ a driving device such as a pump.

The species of metal employed to form the porous metal body 5 are not specifically limited, and metals such as titanium, copper, aluminum, or nickel, precious metals such as gold, silver, and platinum, and alloys such as a nickel-based alloy and a cobalt-based alloy may be employed. Out of the cited materials, one or a combination of two or more may be employed. In particular, titanium is most preferable because of high corrosion resistance that enables the porous metal body 5 to maintain the shape for a long time and to thereby stably perform the humidification. The solvent for manufacturing the porous metal is not specifically limited, and for example water may be employed. Further, the binder resin for manufacturing the porous metal is not specifically limited, and for example an acrylic resin, an epoxy resin, or a polyester resin may be employed. The sintering temperature is not specifically limited, but may be controlled as desired according to the adopted material.

Alternatively, the porous metal body 5 may be composed of a porous body formed of the cited resin and coated with the metal powder.

It is preferable to apply a hydrophilic treatment to the surface layer of the porous metal body 5, from the viewpoint of increasing the amount of the retained humidifying water and preventing degradation in water absorption performance. The method of the hydrophilic treatment is not specifically limited either, and the hydrophilic treatment may be provided, for example, by coating the porous metal body 5 with a hydrophilic resin, or by corona discharge or atmospheric plasma. Hereunder, an example of the hydrophilic treatment for the porous metal body 5 will be described.

(Hydrophilic Treatment)

The following example represents a coating process of a hydrophilic material onto the porous metal body 5. The porous metal body 5 is subjected to atmospheric oxidation at 400° C. for 30 minutes and then to chromate-phosphate treatment for improving the corrosion resistance of the surface, and then soaked in a sodium silicate aqueous solution 100 [mg/L] for 10 minutes to form a silica coating layer by drying at 80° C. for 5 hours.

It is preferable that the film thickness of the coating is in a range of 0.01 [μm] to 10 [μm]. When the film is too thick the pores in the foamed portion are covered, and when the film is too thin the film may be separated with the lapse of time, which leads to degradation in hydrophilicity of the surface and in water retention performance.

Regarding the hydrophilic material, a silane coupling agent or dimethylformamide solution of titanium oxide may be employed as substitute for silica. Alternatively an organic polymer resin may be employed, such as polyvinylalcohol, polyethylene glycol, cellroll, or dimethylformamide solution of an epoxy resin.

The smoother the surface of the porous metal body 5, the more the hydrophilicity increases, and hence the porous metal body 5 may be subjected to a smoothing treatment. In this case, it is preferable to coat the porous metal body 5 with an organic polymer resin. Through the mentioned process, the surface of the porous metal body 5 becomes hydrophilic and therefore the water absorption rate of the porous metal body 5 can be improved.

Here, the atmospheric plasma treatment may be performed as a pretreatment for the coating process. In this case the adhesion between the coating film and the porous metal is enhanced, and the temporal durability of the porous metal body 5 can be improved.

The porous metal body 5 may be obtained by making a sheet-shaped porous metal having a thickness between 0.5 [mm] and 2 [mm] and cutting or processing the porous metal into a desired shape. The processing method is not specifically limited and, for example, wire cutting, laser cutting, press stamping, shaving, manual cutting, or bending may be performed.

It is preferable that the porous metal body 5 has a porosity of 60 [%] to 90 [%], because the porosity in this range allows the porous metal body 5 to absorb a sufficient amount of water and to maintain a sufficient strength. A preferable range of the pore diameter of the porous metal body 5 is 50 [μm] to 600 [μm], because the pore diameter in this range allows the porous metal body 5 to maintain the strength and prevents clogging of the voids 15.

Figure 4:
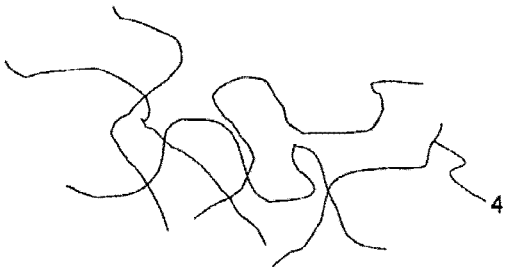
FIG. 4 is an enlarged partial cross-sectional view of a humidifying member composed of a metal fiber, in the humidifier according to Embodiment 1 of the present invention.

Although the porous metal body 5 constitutes the humidifying member in Embodiment 1, metal fiber may be employed as the humidifying member in place of the porous metal body 5. FIG. 4 is an enlarged partial cross-sectional view of the humidifying member composed of metal fiber, in the humidifier according to Embodiment 1 of the present invention. The humidifying member shown in FIG. 4 is composed of a multitude of metal fiber filaments 4 of approximately 0.1 mm in diameter, complicatedly entangled with each other. A plurality of voids are formed among the entangled metal fiber filaments 4, and water is retained in those voids. To form the metal fiber 4, metals such as titanium, copper, aluminum, or nickel, precious metals such as gold, silver, and platinum, and alloys such as a nickel-based alloy and a cobalt-based alloy may be employed, like the porous metal body 5. The metal fiber of such materials may be formed into the same shape as the porous metal body 5 shown in FIG. 1, to constitute the humidifying member.

(Operation of Humidifier)

Referring to FIG. 1, the operation of the humidifier according to Embodiment 1 will now be described. The humidifier according to Embodiment 1 selectively performs the humidifying operation.

First, the humidifying operation of the humidifier will be described.

The water supplied through the supply pipe 1 is stored in the reservoir 2, and the water in the reservoir 2 is conveyed to the nozzle 3 to serve as humidifying water. The humidifying water conveyed to the nozzle 3 is dropped from above the porous metal body 5 to the top portion thereof, in the form of the water droplet 301. The humidifying water is thus supplied to the porous metal body 5. The humidifying water uniformly diffuses throughout the porous metal body 5 through the voids 15 owing to the capillary force of the porous metal body 5 and the gravity to the humidifying water, so that the porous metal body 5 retains a certain amount of water.

When the fan 9 is activated, air is caused to flow from the upstream side (left side in FIG. 1) to the downstream side (right side in FIG. 1) of the porous metal body 5 as indicated by an arrow 200 in FIG. 1, and to pass through the porous metal body 5, and then sucked by the fan 9 (arrow 201 in FIG. 1) and conveyed to outside of the humidifier (arrow 202 in FIG. 1). The water retained by the porous metal body 5 transpires through gas-liquid contact with the air being caused to flow by the fan 9, thereby humidifying the air.

Surplus water in the porous metal body 5 unconsumed for the humidification is deposited in the tip portion 16 in the lower end portion of the porous metal body 5 owing to gravity, and leaks out of the tip portion 16 and drops downward. The water which has leaked out of the porous metal body 5 is received by the drain pan 11 and discharged to outside of the humidifier.

Humidified air can thus be supplied to the space to be humidified, by the mentioned humidifying operation of the humidifier.

The drying operation of the humidifier according to Embodiment 1 will be described hereunder.

The humidifier performs, after the humidifying operation of a predetermined time, the drying operation including stopping the dripping of water from the nozzle 3 and keeping the fan 9 turned on for a predetermined time. Drying the porous metal body 5 by the drying operation suppresses the growth of microbes such as germs and mold in the porous metal body 5. In case that microbes such as germs and mold grows the porous metal body 5 becomes insanitary, and spores of the microbes and mold may be mixed in the air when the humidifying operation is resumed. In the drying operation, air may be supplied as it is, or hot wind heated by a non-illustrated heating device such as a heater may be supplied. Supplying the hot wind can shorten the drying time, but, energy for heating is required. Accordingly, either way may be selected according to the intended design.

It is preferable to determine the frequency of the drying operation according to the propagation rate of the microbes. For example, colibacilus multiplies to an enormous amount in a day under a favorable environment, and therefore it is preferable to perform the drying operation after the humidifying operation for the day is finished. However, drying the porous metal body 5 excessively frequently allows scales in the water to precipitate thereby degrading the humidifying performance, and therefore it is preferable to determine the frequency of the drying operation in consideration of the growth rate of germs and mold, as well as the hardness of the tap water.

(Advantageous Effects of Embodiment 1)

As described above, the humidifier according to Embodiment 1 is configured to discharge the surplus water in the porous metal body 5 through the tip portion 16. Accordingly, dews are barely deposited in the lower end portion of the porous metal body 5, and therefore the growth of germs and mold can be suppressed.

Figure 5:
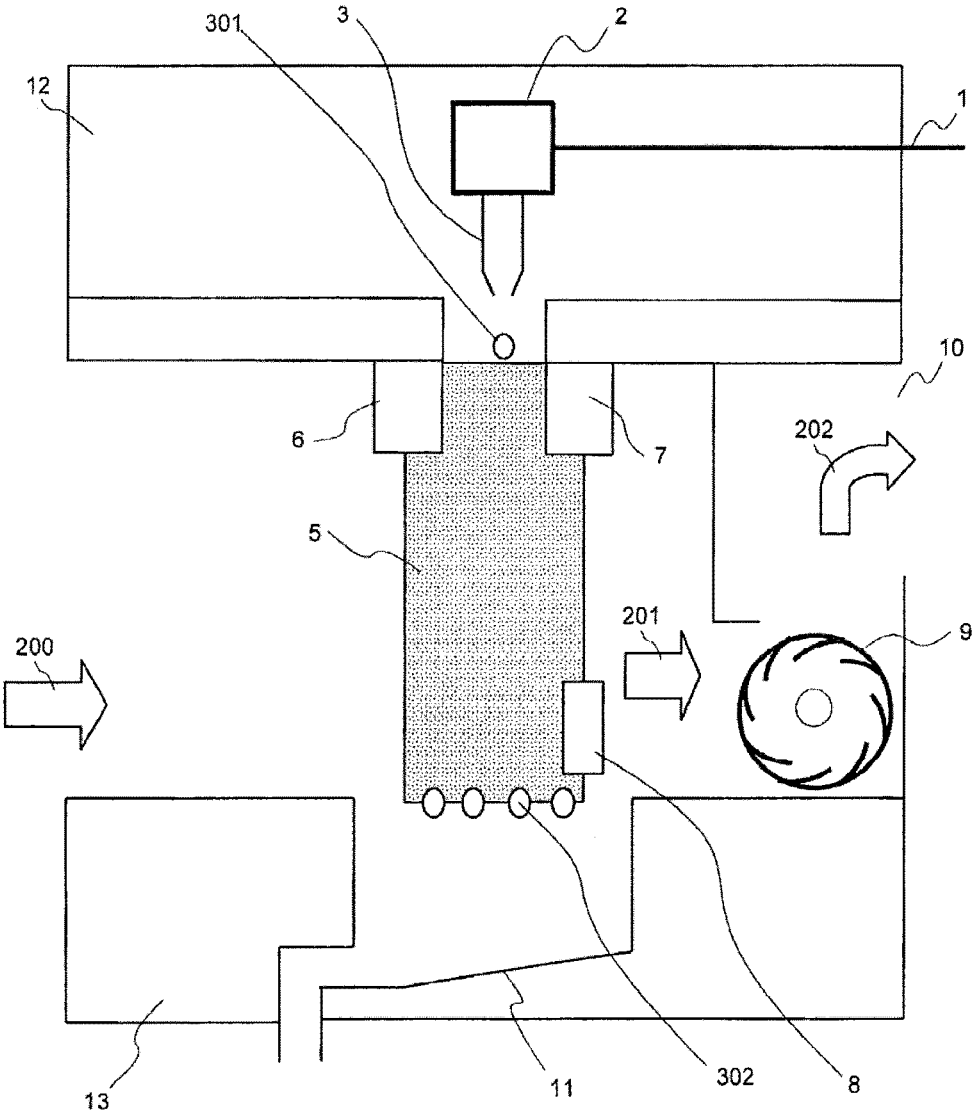
FIG. 5 is a drawing showing a humidifier according to a comparative example.

Here, FIG. 5 illustrates a comparative example for explaining the advantage of the humidifier according to Embodiment 1 of the present invention. In the humidifier according to the comparative example shown in FIG. 5, the bottom face of the porous metal body 5 is a horizontal face unlike Embodiment 1. When the bottom face of the porous metal body 5 is horizontal as shown in FIG. 5, water is prone to be deposited throughout the lower end portion of the porous metal body 5, from the upstream region to the downstream region. Accordingly, the drying operation has to be performed for a longer time to dry the porous metal body 5, which leads to waste of energy. In case that the drying time is insufficient and water droplets 302 remain in the porous metal body 5 slime is prone to be generated, and therefore odor is prone to be generated at the air outlet 10, and spores of microbes and mold are prone to be mixed in the humidified air.

Figure 6:
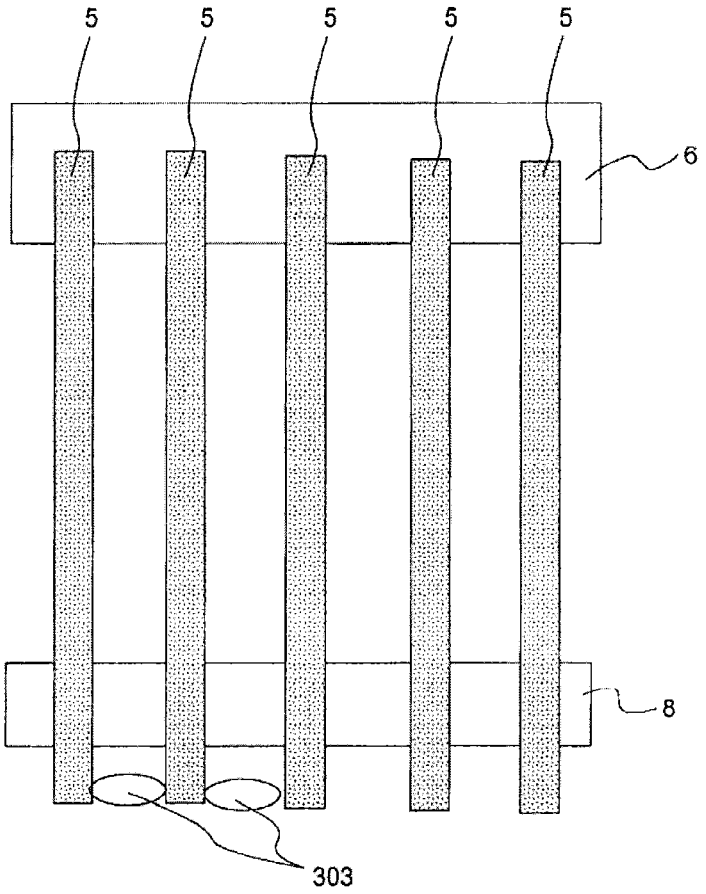
FIG. 6 is a drawing of the porous metal bodies 5 with dew bridges 303 formed in the gaps thereof.

When water is deposited in the lower end portion of the porous metal body 5, dews may form a chain in the gaps between the plurality of porous metal bodies 5, which is known as bridging. Here, FIG. 6 illustrates the porous metal body 5 with dew bridges 303 formed in the gaps thereof. The dew bridges 303 formed as shown in FIG. 6 not only encourage the growth of slime, but also degrade the humidifying performance of the porous metal body 5, since the airflow is blocked by the dew bridges 303.

When the water in the lower end portion of the porous metal body 5 is not efficiently discharged as above, microbes such as germs and mold is prone to grow and the humidifying performance is prone to be degraded.

However, forming the tip portion 16 of a pointed shape protruding downward from the lower end portion of the porous metal body 5 as in Embodiment 1 instead of forming the lower end portion in the horizontal flat shape enables the water in the lower portion of the porous metal body 5 to be efficiently discharged. Efficiently discharging the water in the lower portion of the porous metal body 5 as above suppresses the growth of microbes such as germs and mold as well as the degradation in humidifying performance, thereby maintaining the humidifying performance unchanged from the initial state, for a longer period of time.

Here, it is preferable to form the lower support member 8 so as to support the downstream-side sidewall of the porous metal body 5 as shown in FIG. 1, instead of the bottom face of the porous metal body 5. In the case where the lower support member 8 is configured so as to support the bottom face of the porous metal body 5, the water is prone to be deposited in the joint portion between the lower support member 8 and the porous metal body 5, which encourages generation of slime. However, forming the lower support member 8 so as to support the sidewall of the porous metal body 5 at an upper position with respect to the bottom face prevents the water from accumulating in the joint portion between the lower support member 8 and the porous metal body 5.

Further, when the angle θ1 of the tip portion 16 is too large the water is unable to be efficiently prevented from accumulating in the lower end portion of the porous metal body 5, and when the angle θ1 is too small the porous metal body 5 becomes more difficult to process, and the strength of the tip portion 16 declines. Accordingly, it is preferable to determine the angle θ1 of the tip portion 16 in consideration of the extent of accumulation of water in the lower end portion of the porous metal body 5, the processability of the porous metal body 5, and the strength of the tip portion 16, for example in a range of 30 to 150 degrees.

Figure 7:
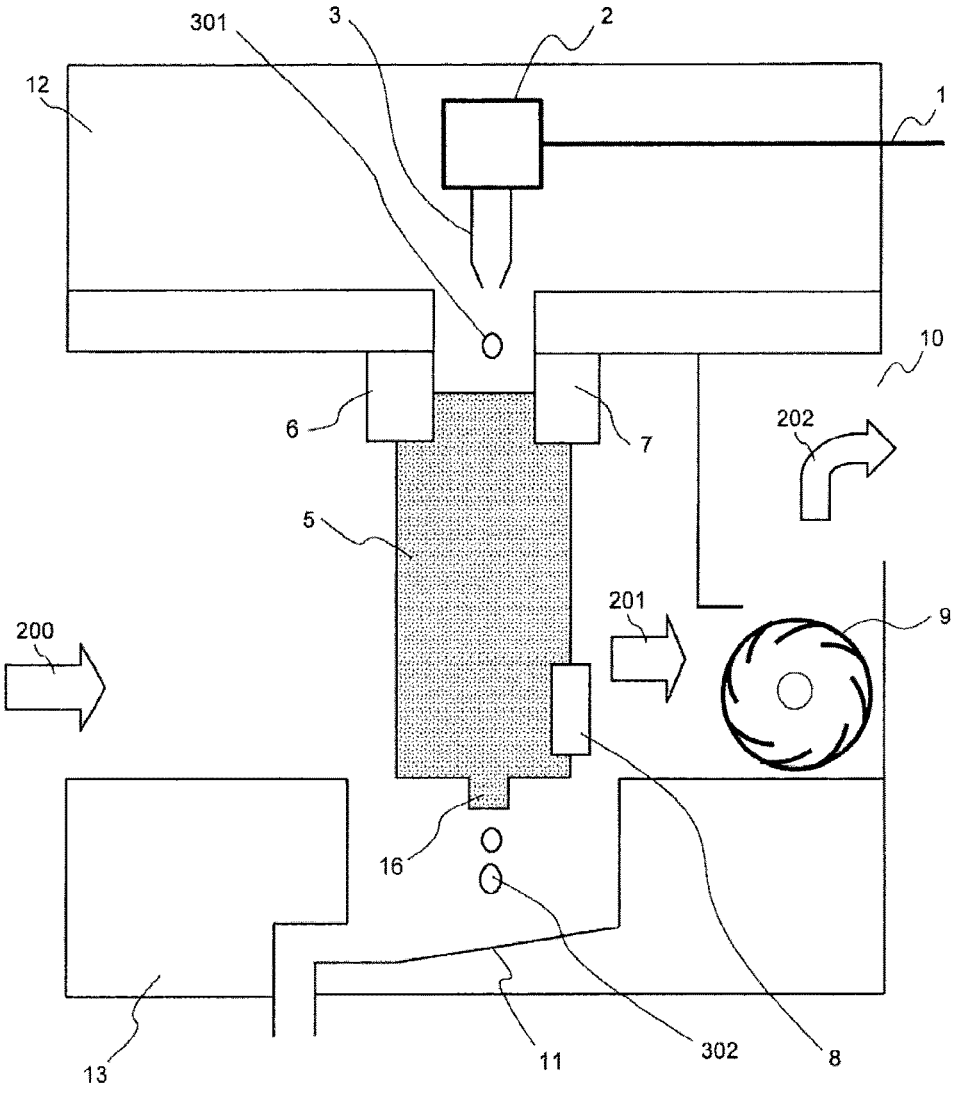
FIG. 7 is a drawing showing a configuration of a modification of the porous metal body 5 of the humidifier according to Embodiment 1 of the present invention.

Although the tip portion 16 is formed in a pointed shape (triangular shape) in the example shown in FIG. 1, the tip portion 16 may be formed in different shapes. FIG. 7 is a schematic side view showing a configuration of a modification of the porous metal body 5 of the humidifier according to Embodiment 1 of the present invention. In the example shown in FIG. 7, the tip portion 16 is formed in a rectangular shape protruding downward. More specifically, a projection downwardly protruding in a step shape is formed at the central portion of the bottom face of the porous metal body 5 in the depth direction, so as to constitute the tip portion 16. The cross-sectional area of the tip portion 16 taken along a horizontal plane is smaller than the cross-sectional area of the porous metal body 5 taken along a horizontal plane at an upper position of the tip portion 16. In the case of forming the tip portion 16 in the shape of the rectangular projection also, the water is led to the tip portion 16 of the porous metal body 5, and the surplus water in the porous metal body 5 can be efficiently discharged. Accordingly, the growth of microbes such as germs and mold as well as the degradation in humidifying performance of the porous metal body 5 can be suppressed, and therefore the humidifying performance unchanged from the initial state can be maintained for a long period of time. Here, when the width (size in the depth direction) of the projection constituting of the tip portion 16 is large, effect of water discharge is small, and when the width of the projection is too small the porous metal body 5 becomes more difficult to process, and the strength of the tip portion 16 declines. Accordingly, it is preferable to form the tip portion 16 of the rectangular shape with an appropriate width (size in the depth direction), for example in a range of 2 [mm] to 10 [mm]. In addition, the shape of the projection constituting the tip portion 16 may be a circular column shape, a circular conical shape, or a truncated conical shape, instead of the rectangular column shape.

Figure 8:
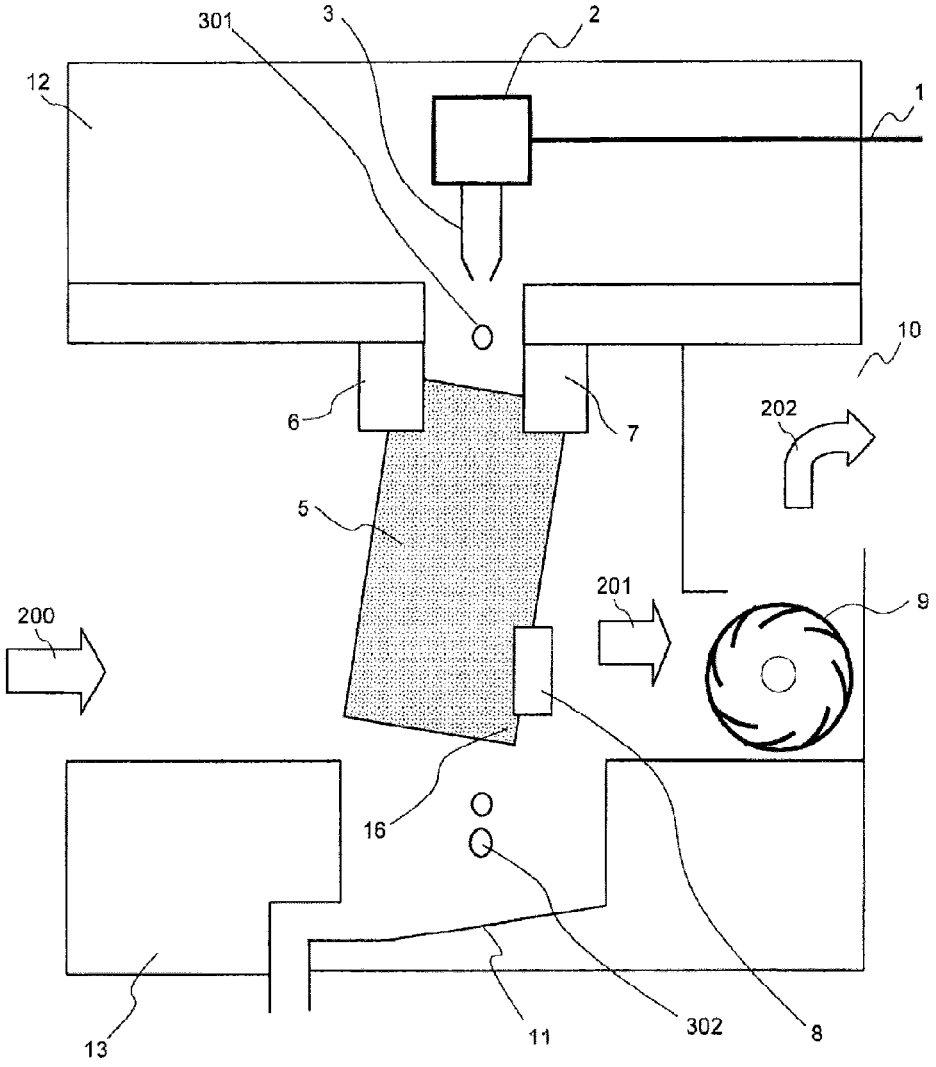
FIG. 8 is a drawing showing a configuration of another modification of the porous metal body 5 of the humidifier according to Embodiment 1 of the present invention.

Although the porous metal body 5 is formed in a pentagonal shape and one of the vertices of the pentagon is formed as the tip portion 16 in the example shown in FIG. 1, the porous metal body 5 may be formed as illustrated in FIG. 8. FIG. 8 is a schematic side view showing a configuration of another modification of the porous metal body 5 of the humidifier according to Embodiment 1 of the present invention. In the example shown in FIG. 8, the porous metal body 5 of a rectangular shape is tilted in the depth direction, so that one of the two lower corners of the rectangular shape is located at a lower position than the other, and the lower corner portion serves as the tip portion 16. Accordingly, the cross-sectional area of the porous metal body 5 taken along a horizontal plane becomes smaller toward the lower position. In the case of utilizing the corner portion of the rectangular-shaped porous metal body 5 as the tip portion 16 also, the water in the porous metal body 5 can be efficiently discharged as the examples shown in FIG. 1 and FIG. 7. Therefore, the growth of microbes such as germs and mold can be suppressed, and the humidifying performance unchanged from the initial state can be maintained.

Embodiment 2

A humidifier according to Embodiment 2 will be described hereunder, focusing on differences from Embodiment 1.

Figure 9:
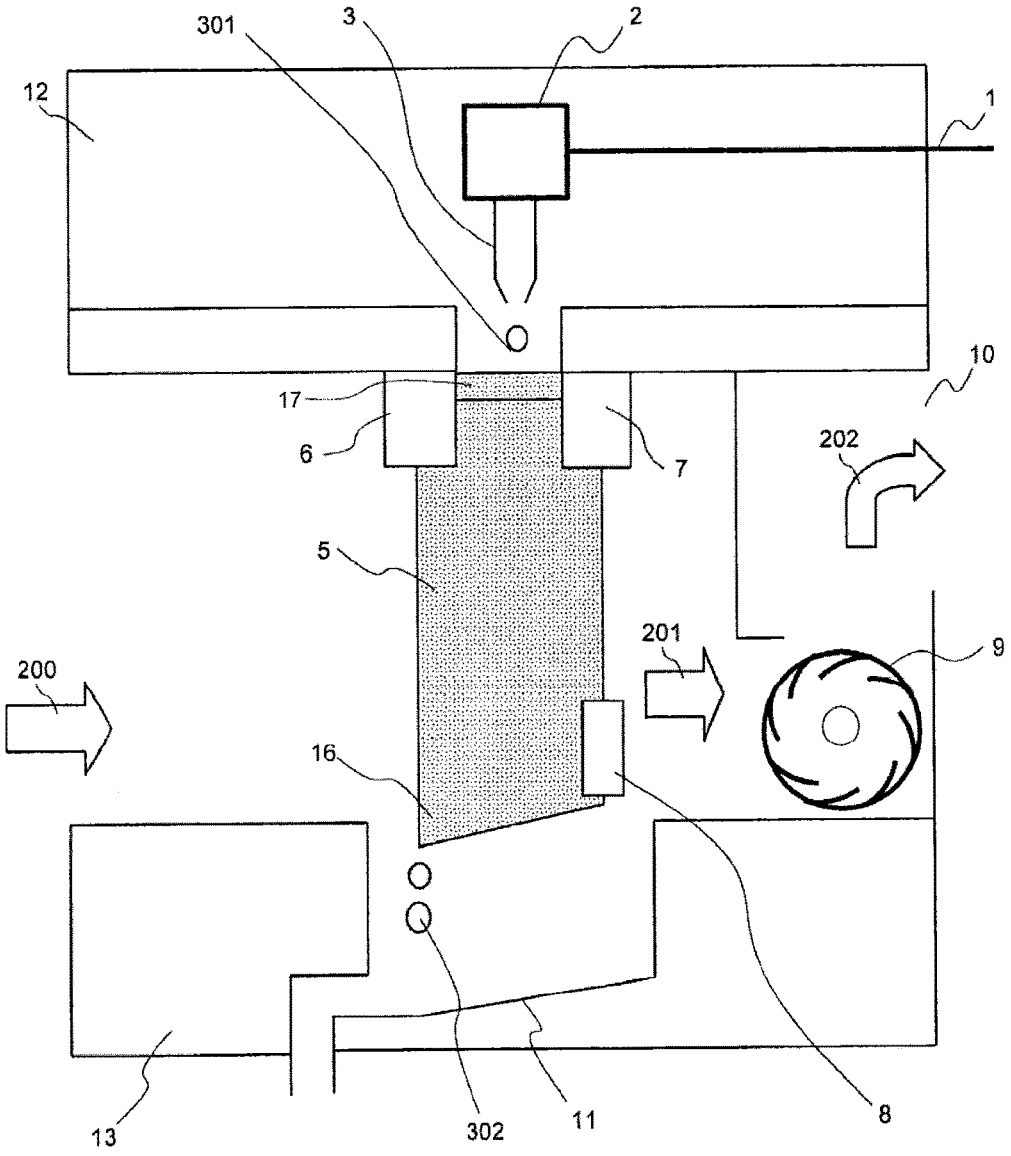
FIG. 9 is a drawing showing a configuration of a humidifier according to Embodiment 2 of the present invention.

FIG. 9 is a schematic side view showing a configuration of the humidifier according to Embodiment 2 of the present invention.

In Embodiment 1, the tip portion 16 is located at the central portion of the bottom face of the porous metal body 5, as shown in FIG. 1.

In contrast, in Embodiment 2, the porous metal body 5 includes the tip portion 16 protruding downward from the upstream side of the airflow (left side in FIG. 9), as shown in FIG. 9. In the example according to Embodiment 2, the bottom face of the porous metal body 5 is inclined upward from the tip portion 16 toward the deeper side.

In addition, an upper porous metal body 17, corresponding to the upper humidifying member, is provided on the porous metal body 5 according to Embodiment 2.

Figure 10:
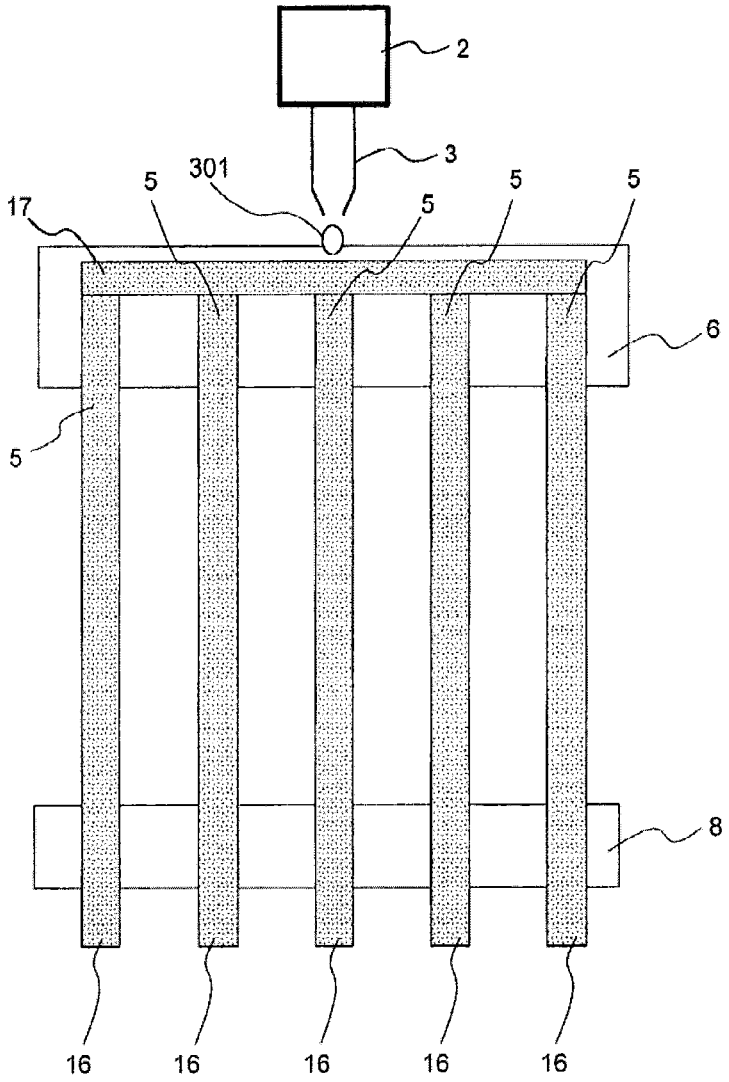
FIG. 10 is a drawing of an essential part of the humidifier according to Embodiment 2 of the present invention, viewed from the upstream side.

FIG. 10 is a drawing of an essential part of the humidifier according to Embodiment 2 of the present invention, viewed from the upstream side. As shown in FIG. 10, the upper porous metal body 17 is provided so as to cover the top faces of all the porous metal bodies 5. In addition, the upper porous metal body 17 is subjected to a load from above, so as to make close contact with the porous metal body 5. The upper porous metal body 17 serves as a buffer for transmitting water to the porous metal body 5, rather than for humidification of air. More specifically, the water dripping from the nozzle 3 is once absorbed by the upper porous metal body 17 and transmitted, after the entirety of the upper porous metal body 17 is impregnated with the water, to the porous metal body 5 from the lower end portion of the upper porous metal body 17.

The humidifying operation of the humidifier is the same as the operation according to Embodiment 1.

In the humidifying operation, the air is sequentially humidified while flowing from the upstream side (left side in FIG. 9) to the downstream side (right side in FIG. 9) of the porous metal body 5, and hence the air in the downstream region of the porous metal body 5 has a higher relative humidity compared with the air on the upstream region. Since the humidification capacity is proportional to the steam pressure, the humidifying performance is degraded when the humidity of the air is high. More specifically, when the humidifying operation is performed with the porous metal body 5 uniformly impregnated with water, the water in the upstream region of the porous metal body 5 is first consumed for the humidification, and therefore a relatively small amount of water remains in the upstream region and a relatively large amount of water remains in the downstream region.

In Embodiment 2, however, the tip portion 16 is provided in the upstream region of the porous metal body 5, in consideration of the mentioned phenomenon. Such a configuration facilitates the water to be deposited in the tip portion 16 and the upper region thereof, thereby allowing a larger amount of water to be supplied to the upstream region of the porous metal body 5. Therefore, unevenness of water distribution throughout the porous metal body 5 during the humidifying operation can be minimized.

In Embodiment 2, the water is once absorbed by the upper porous metal body 17 and then supplied to the porous metal body 5 via the upper porous metal body 17, and therefore unevenness of water distribution in the upper portion of the porous metal body 5 can be minimized.

Here, although the tip portion 16 is provided in the upstream region of all the porous metal bodies 5 as shown in FIG. 9, the tip portions 16 of the respective porous metal bodies 5 may be alternately located, in such a pattern as "upstream region—central portion—upstream region—central portion—upstream region", or "upstream region—downstream region—upstream region—downstream region—upstream region", so that the respective tip portions 16 of the porous metal bodies 5 adjacent to each other are located at different positions in the depth direction. Alternatively, the tip portion 16 may be formed in the upstream region of all the porous metal bodies 5, and the porous metal bodies 5 may be formed in different lengths in the up-down direction, so that the tip portions 16 are alternately located in the up-down direction. The mentioned configurations more effectively suppress the formation of the bridges 303 shown in FIG. 6.

The drying operation is performed in the same way as in Embodiment 1.

(Advantageous Effects of Embodiment 2)

The tip portions 16 are formed in the respective porous metal bodies 5 as described above, and therefore the water in the lower end portion of the porous metal bodies 5 can be efficiently discharged as in Embodiment 1. Consequently, the growth of germs and mold can be suppressed, and the humidifying performance unchanged from the initial state can be maintained. In addition, the tip portion 16 is provided in the upstream region of the porous metal body 5 along the airflow direction in Embodiment 2, and therefore unevenness of water distribution in the porous metal body 5 can be minimized. Consequently, the water in the porous metal body 5 can be efficiently utilized for the humidifying operation, which leads to improved humidifying performance.

Further, in Embodiment 2 the upper porous metal body 17 is provided so as to cover the plurality of porous metal bodies 5 in close contact therewith, to thereby supply the water from the reservoir 2 into each of the porous metal bodies 5 through the upper porous metal body 17. Therefore, unevenness of water distribution in the porous metal body 5 can be minimized, and the humidification can be efficiently performed.

Embodiment 3

A humidifier according to Embodiment 3 will be described hereunder, focusing on differences from Embodiment 2.

The configuration of the humidifier according to Embodiment 3 is the same as that of the humidifier according to Embodiment 2 shown in FIG. 9. However, the upper upstream support member 6, the upper downstream support member 7, and the lower support member 8 in Embodiment 3 are formed of a material having a high heat conductance, and tightly joined to the casings 12, 13. Examples of the material having a high heat conductance include metals such as titanium, copper, aluminum, or nickel, and precious metals such as gold, silver, and platinum.

In addition, the porous metal body 5 and the casings 12, 13 are also formed of a material having a high heat conductance, in Embodiment 3. The heat conductance of the upper upstream support member 6, the upper downstream support member 7, and the lower support member 8 is equal to or higher than that of the porous metal body 5.

Figure 11:
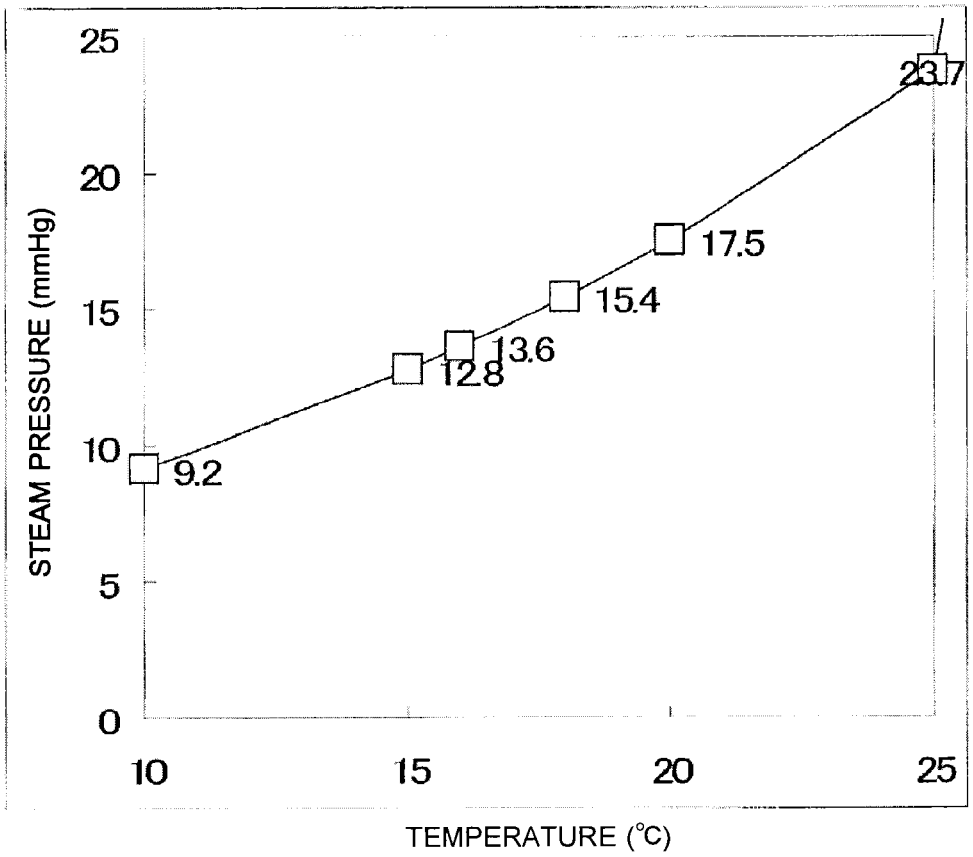
FIG. 11 is a characteristic diagram showing temperature dependence of steam pressure of water, based on Antoine equation.

FIG. 11 is a characteristic diagram showing temperature dependence of steam pressure of water, based on Antoine equation.

The Antoine equation is expressed as the following formula (1).

[Math. 1]

$$\log 10p = A - \frac{B}{T + C} \quad (1)$$

In the cited equation, p represents the steam pressure. A, B, and C are Antoine constants that depend on the material and the unit of temperature. When mmHg is adopted as the unit of p and Celsius is adopted as the unit of T for water, A is 8.0275, B is 1705.62, and C is 231.41.

As shown in FIG. 11, the steam pressure depends on the temperature, and it is known that the steam pressure increases the higher the temperature is. Since the steam pressure is proportional to the humidification capacity, increasing the temperature of the porous metal body 5 enables the humidifying performance to be improved.

On the other hand, the temperature of the porous metal body 5 is lowered owing to evaporation latent heat generated through the humidification. When the temperature of the porous metal body 5 falls the humidification capacity is degraded, and therefore it is effective to quickly discharge the cooling energy generated from the evaporation latent heat from the porous metal body 5, in order to maintain the humidifying performance level.

Accordingly, although either of the porous metal body 5 and the metal fiber may be employed as the humidifying member in Embodiment 1, it is preferable to employ the porous metal body 5 as the humidifying member in Embodiment 3, for the following reason. In comparison between the porous metal body 5 shown in FIG. 3 and the metal fiber shown in FIG. 4, the contacts among the metal fiber filaments shown in FIG. 4 are point contacts and hence the contact area is small, while in the porous metal body 5 shown in FIG. 3 the metal portion is substantially integrated. Because of such difference in contact area, the porous metal body 5 and the metal fiber become largely different from each other in heat conduction performance. More specifically, the heat conduction performance, and hence the humidifying performance of the metal fiber are lower than those of the porous metal body 5. That is why it is more preferable to employ the porous metal body 5 as the humidifying member.

The operation of the humidifier is the same as that according to Embodiment 1.

(Advantageous Effects of Embodiment 3)

In Embodiment 3, the porous metal body 5 formed of a metal having a high heat conductance is employed as the humidifying member, and the upper upstream support member 6, the upper downstream support member 7, and the lower support member 8 are formed of a metal or a ceramic having a heat conductance equal to or higher than that of the porous metal body 5. In addition, the upper upstream support member 6, the upper downstream support member 7, and the lower support member 8 are tightly joined to the porous metal body 5 and also to the casing 12 and the casing 13, so as to constitute an integrated structure. The mentioned configuration allows the cooling energy generated in the porous metal body 5 owing to the evaporation latent heat to be efficiently discharged to outside, and prevents the degradation in humidifying performance. In the drying operation also, the evaporation latent heat can be efficiently discharged to outside as in the humidifying operation, and therefore the water in the tip portion 16 of the porous metal body 5 can be efficiently dried, which shortens the time required for the drying operation. Efficiently drying thus the water in the lower end portion of the porous metal body 5 suppresses the growth of germs and mold, thereby maintaining the humidifying performance unchanged from the initial state.

Embodiment 4

A humidifier according to Embodiment 4 will be described hereunder, focusing on differences from Embodiment 3.

Figure 12:
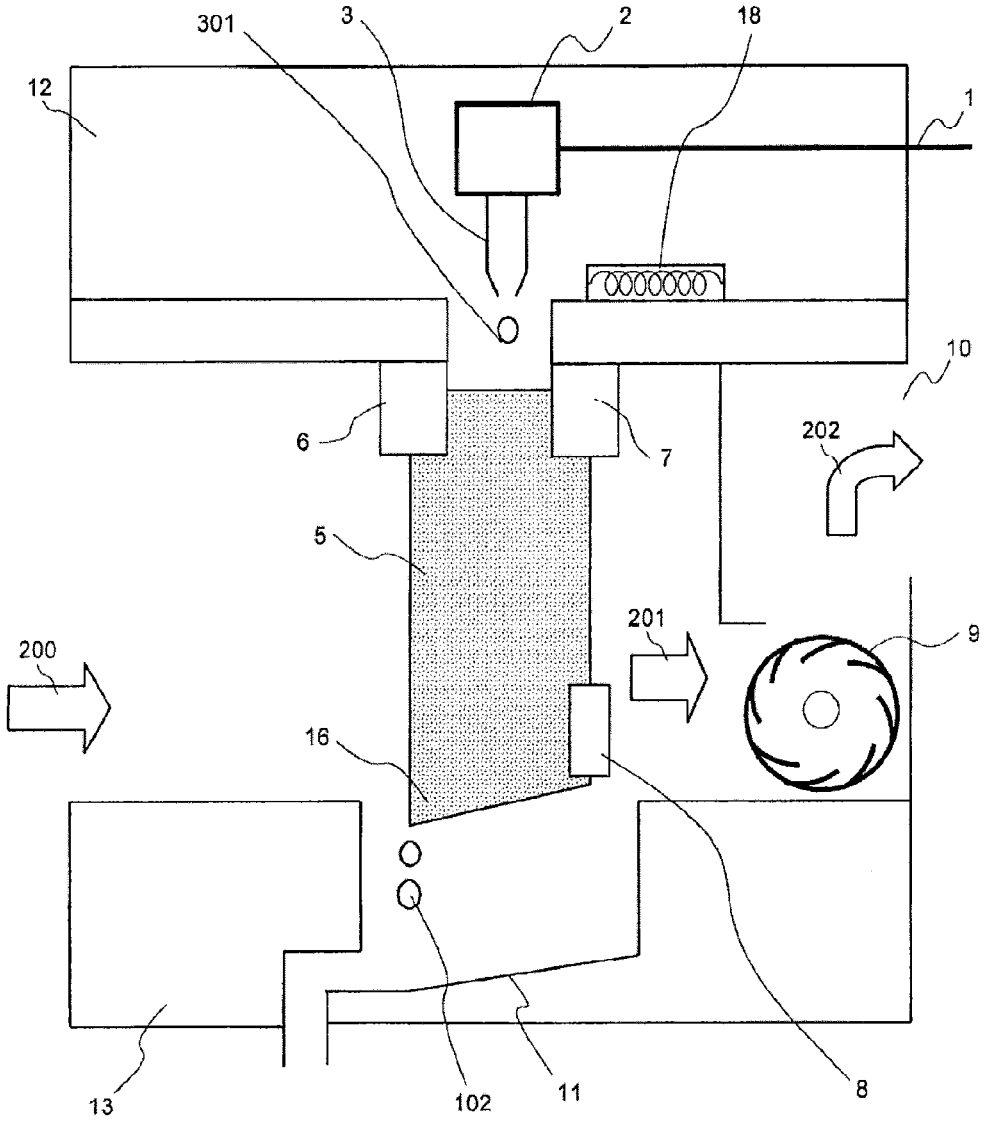
FIG. 12 is a drawing showing a configuration of a humidifier according to Embodiment 4 of the present invention.

FIG. 12 is a schematic side view showing a configuration of the humidifier according to Embodiment 4 of the present invention. FIG. 12 is different from FIG. 9 in that a heater 18, exemplifying the heating device, is provided in the casing 12. The heater 18 serves to heat up the porous metal body 5. The heater 18 may be constituted of any material that generates heat, and for example a nichrome wire, a positive temperature coefficient (PTC) heater, a heat pump, or a Peltier device may be employed. It is preferable to mount the heater 18 in the vicinity of the upper upstream support member 6 or the upper downstream support member 7, because a position closer to the porous metal body 5 provides higher heat conduction performance. Mounting thus the heater 18 enables the porous metal body 5 to be heated by the heat generated from the heater 18.

In the humidifier according to Embodiment 4, a voltage is applied to the heater 18 in the drying operation to heat the porous metal body 5, thereby improving the efficiency of the drying operation. The remaining portions of the humidifier are configured in the same way as Embodiment 1.

(Advantageous Effects of Embodiment 4)

In Embodiment 4, the porous metal body 5 formed of a metal having a high heat conductance is employed as the humidifying member, and the upper upstream support member 6, the upper downstream support member 7, and the lower support member 8 are formed of a metal or a ceramic having a heat conductance equal to or higher than that of the porous metal body 5, as in Embodiment 3. In addition, the upper upstream support member 6, the upper downstream support member 7, and the lower support member 8 are tightly joined to the porous metal body 5 and also to the casing 12 and the casing 13, so as to constitute an integrated structure. The mentioned configuration allows, as in Embodiment 3, the cooling energy generated in the porous metal body 5 owing to the evaporation latent heat to be efficiently discharged to outside, and prevents the degradation in humidifying performance.

In Embodiment 4, further, the heater 18 is provided in the casing 12 to heat up the porous metal body 5 with the heater 18 during the drying operation. Accordingly, the evaporation latent heat can be efficiently discharged to outside during the drying operation also, as during the humidifying operation. Therefore, the water in the tip portion 16 of the porous metal body 5 can be efficiently dried, which shortens the time required for the drying operation. Efficiently drying thus the water in the lower end portion of the porous metal body 5 suppresses the growth of germs and mold, thereby maintaining the humidifying performance unchanged from the initial state.

Other than the foregoing example including the heater 18, for example the following configuration may be adopted.

Figure 13:
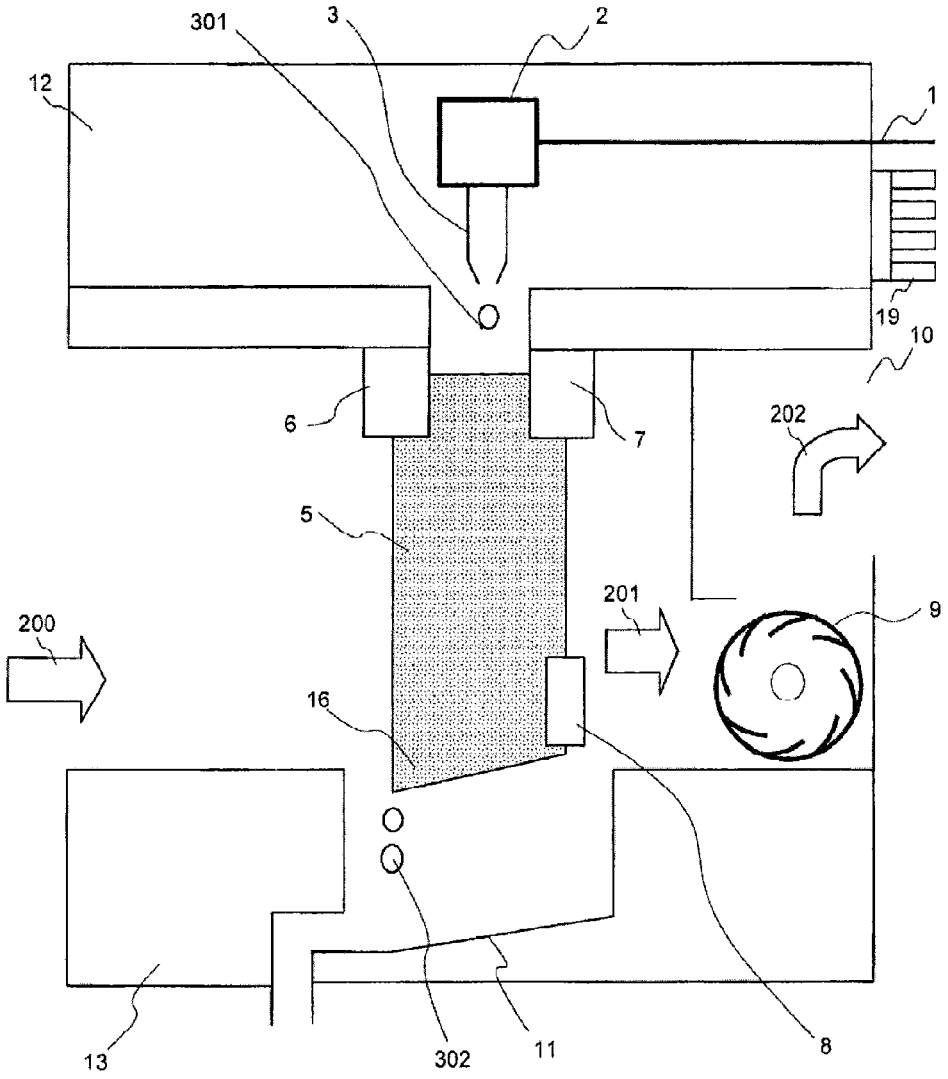
FIG. 13 is a drawing showing another configuration of the humidifier according to Embodiment 4 of the present invention.

FIG. 13 is a schematic side view showing another configuration of the humidifier according to Embodiment 4 of the present invention. In the example shown in FIG. 13, a heat transfer fin 19, for example formed of aluminum, is mounted in the casing 12 in place of the heater 18. The heat of the porous metal body 5 is transmitted to the heat transfer fin 19 through the upper upstream support member 6 or the upper downstream support member 7, and the casing 12. Providing thus the heat transfer fin 19 also provides the same advantageous effects as those provided by the heater 18.

In addition, although not illustrated, a substrate circuit including circuit parts for causing the humidifier to operate may be provided, instead of the heater 18, at a position that allows heat to be transmitted to the porous metal body 5. The substrate circuit generates heat during the operation, and hence the heat of the substrate circuit is transmitted to the porous metal body 5 through the casing 12, the upper upstream support member 6, the upper downstream support member 7, and the lower support member 8, for example when the substrate circuit is provided at the same position where the heater 18 is to be mounted. Therefore, the same advantageous effects as those provided by the heater 18 can be attained.

Although the heating device (heater 18 or substrate circuit) for heating the porous metal body 5 and the heat transfer device (heat transfer fin 19) that transfers the heat transmitted from the porous metal body 5 are provided in the casing 12 in the foregoing example, the positions where the heating device and the heat transfer device are to be mounted are not limited to the casing 12. The heating device and the heat transfer device may be mounted at desired positions, provided that the heating device and the heat transfer device can perform the intended functions.

Embodiment 5

A humidifier according to Embodiment 5 will be described hereunder, focusing on differences from Embodiment 1.

The humidifier according to Embodiment 5 is configured to increase the velocity of air passing through the porous metal body 5 in the drying operation, compared with the velocity in Embodiment 1.

Figure 14:
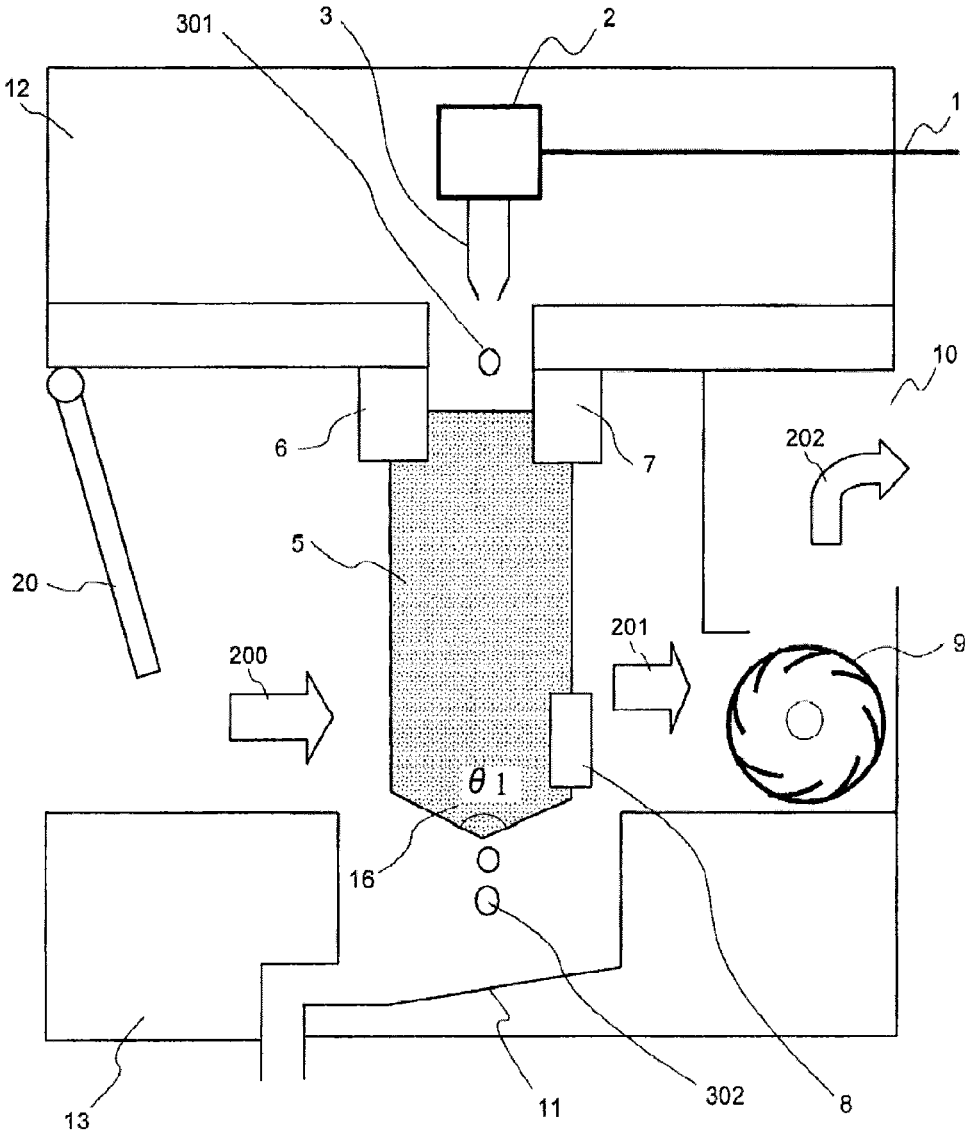
FIG. 14 is a drawing showing a configuration of a humidifier according to Embodiment 5 of the present invention.

FIG. 14 is a schematic side view showing a configuration of the humidifier according to Embodiment 5 of the present invention. As shown in FIG. 14, a damper 20 is provided in the upstream region of the porous metal body 5. The damper 20 serves to change the flow path of air flowing toward the porous metal body 5. The damper 20 is configured to narrow down the cross-sectional area of the flow path to thereby cause the air to preferentially flow to the vicinity of the tip portion 16 of the porous metal body 5, as shown in FIG. 14. Even though the water droplets 302 stick to the tip portion 16 owing to surface tension, the dews can be forcibly blown away by applying an external force greater than the surface tension. In addition, reducing the cross-sectional area of the flow path with the damper 20 allows the velocity of air passing through the porous metal body 5 to be increased, and therefore the water droplets 302 remaining in the tip portion 16 can be more quickly dried and the time required for drying the porous metal body 5 can be shortened.

Hereunder, the operation of the humidifier according to Embodiment 5 will be described. In the humidifying operation, the damper 20 is controlled so as to maximize the cross-sectional area of the flow path of air flowing toward the porous metal body 5. The operation in the other aspects in the humidifying operation is the same as that of Embodiment 1.

Further, in the drying operation the damper 20 narrows down the cross-sectional area of the flow path of air flowing toward the porous metal body 5, to thereby preferentially cause the air to flow to the vicinity of the tip portion 16, as shown in FIG. 14. The operation in the other aspects in the humidifying operation is the same as that of Embodiment 1.

(Advantageous Effects of Embodiment 5)

In Embodiment 5, the air passing the vicinity of the porous metal body 5 in the drying operation is caused to flow at a higher velocity than the air in the humidifying operation, and therefore the same advantageous effects as those provided by the Embodiment 1 can be obtained and, in addition, the porous metal body 5 can be efficiently dried in the drying operation. Therefore, the time required for the drying operation can be shortened.

In Embodiment 5, further, air is preferentially caused to flow toward the tip portion 16 of the porous metal body 5 in the drying operation. Therefore, the tip portion 16 of the porous metal body 5 can be efficiently dried. Consequently, the growth of germs and mold in the tip portion 16 can be suppressed, and the humidifying performance unchanged from the initial state can be maintained.

Although the damper 20 is provided to increase the velocity of air passing through the porous metal body 5 in the foregoing example, the rotation speed of the fan 9 per unit time may be increased in the drying operation, instead of or in addition to providing the damper 20. Such an arrangement also allows the velocity of air passing through the porous metal body 5 to be increased, and therefore the time required for the drying operation can be shortened.

Embodiment 6

A humidifier according to Embodiment 6 will be described hereunder, focusing on differences from Embodiment 1.

Figure 15:
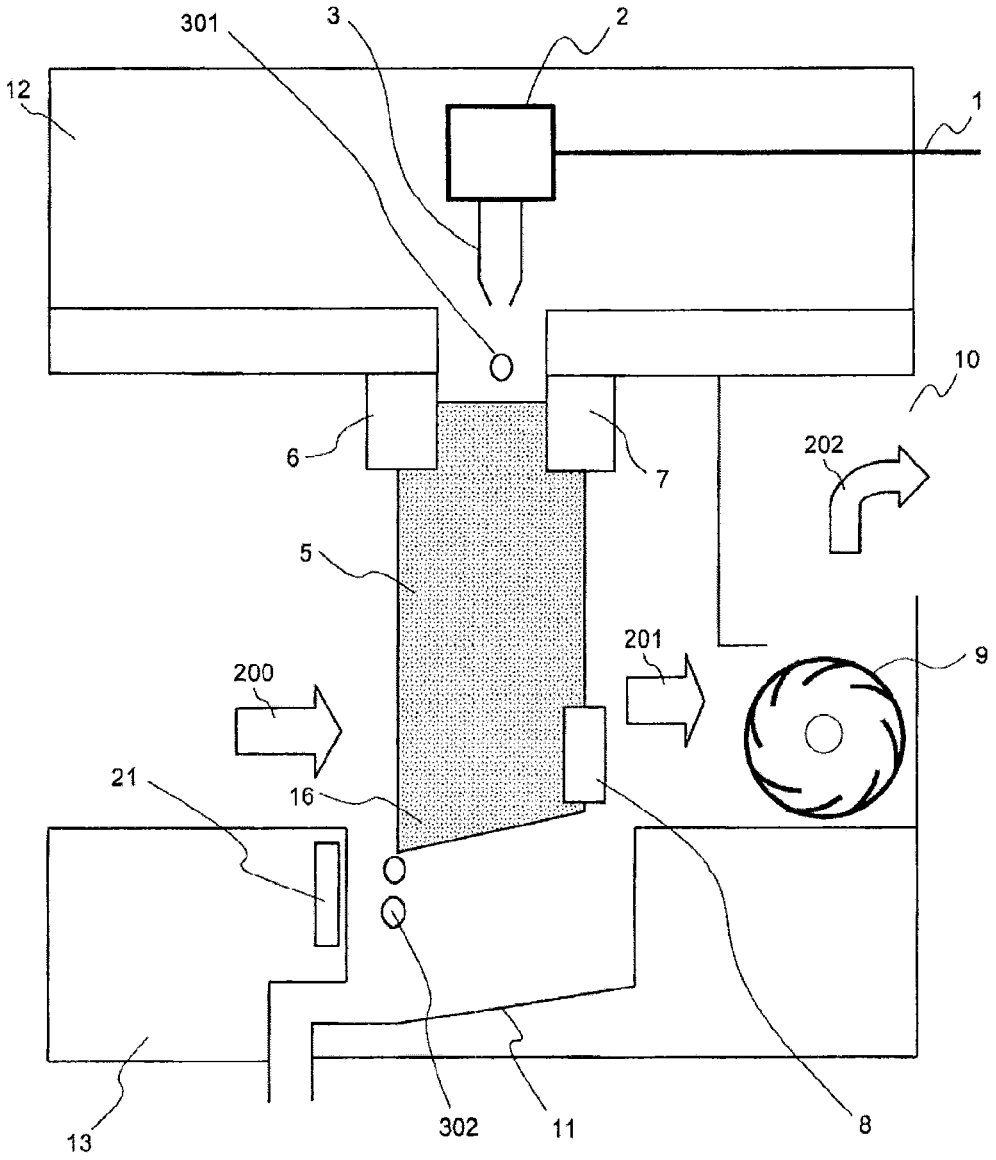
FIG. 15 is a drawing showing a configuration of a humidifier according to Embodiment 6 of the present invention.

FIG. 15 is a schematic side view showing a configuration of the humidifier according to Embodiment 6. As shown in FIG. 15, a sensor 21 that detects whether the water droplets 302 are present in the tip portion 16, exemplifying the moisture detecting device, is provided in the casing 13 so as to be opposed the tip portion 16 of the porous metal body 5. The sensor 21 serves to detect whether the water droplets 302 is present in the detection region, for example by a light scattering method.

Figure 16:
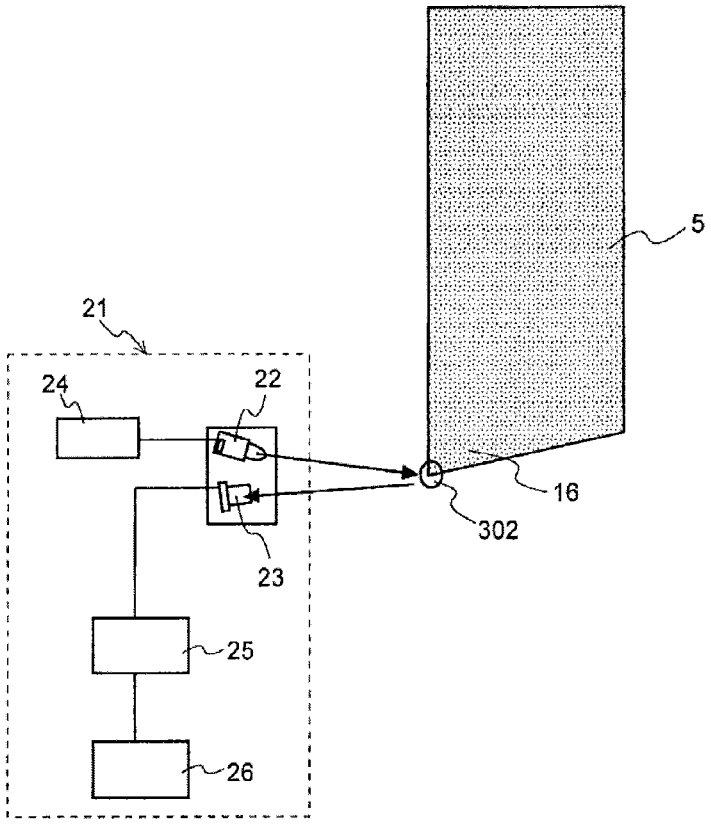
FIG. 16 is a drawing for explaining a sensor 21 of the humidifier according to Embodiment 6 of the present invention.

FIG. 16 is a schematic drawing for explaining the sensor 21 of the humidifier according to Embodiment 6 of the present invention. As shown in FIG. 16, the sensor 21 includes a light emitting diode (LED) 22 serving as a light source that emits light, a photomultiplier 23 that outputs a signal according to the amount of received light, a power source 24 that supplies power to the LED 22, an amplifier circuit 25 that amplifies the output from the photomultiplier 23, and a determination device 26 that determines whether the water droplet 302 is present, on the basis of the output from the amplifier circuit 25. The wavelength of the light to be emitted from the LED 22 is not specifically limited, and light of a broad range from ultraviolet light to infrared light may be utilized. The light source is not limited to the LED, and a different type of device that emits light may be employed as the light source. The determination device 26 is composed of circuit parts capable of comparing values, for example, between the output from the amplifier circuit 25 and a predetermined threshold. The result reached by the determination device 26 is inputted to a non-illustrated controller of the humidifier.

The operation of the humidifier according to Embodiment 6 will be described hereunder.

When the water droplet 302 is present on the optical path of the light from the LED 22 in the drying operation, the light from the LED 22 is scattered and a part of the scattered light enters the photomultiplier 23. The light incident on the photomultiplier 23 generates electromotive force, and is hence boosted to a certain voltage in the amplifier circuit 25 and inputted to the determination device 26. The determination device 26 determines whether the water droplet 302 is present through comparison between a predetermined voltage threshold and the inputted value, and inputs the determination result to the controller. The controller continues the drying operation when it is decided that the water droplet 302 is present, and stops the drying operation when it is decided that the water droplet 302 is not present.

Here, the rotation speed of the fan 9 may be controlled according to the output from the amplifier circuit 25, instead of deciding whether the water droplet 302 is present with the determination device 26 on the basis of the threshold.

Although the sensor 21 according to Embodiment 6 is based on the light scattering method, a sensor that detects humidity may be employed in place of the sensor 21. In the case of employing the humidity sensor also, whether the water droplet 302 is present may be decided through comparison between the detected humidity and a predetermined threshold as in the case of the sensor 21 based on the light scattering method, and alternatively the rotation speed of the fan 9 may be controlled according to the output from the amplifier circuit 25.

The humidifying operation in Embodiment 6 is the same as the operation according to Embodiment 1.

(Advantageous Effects of Embodiment 6)

In Embodiment 6, the sensor 21 detects whether the water droplet 302 is present in the vicinity of the tip portion 16 of the porous metal body 5, and the drying operation is performed according to the detection result. Since the drying operation is continued while the water droplet 302 remains in the tip portion 16, the growth of germs and mold in the porous metal body 5 can be suppressed, and the humidifying performance unchanged from the initial state can be maintained. In addition, since the drying operation is stopped when the water droplet 302 is no longer present in the tip portion 16, unnecessary drying operation can be avoided and the energy consumption can be reduced.

Embodiment 7

A humidifier according to Embodiment 7 will be described hereunder, focusing on differences from Embodiment 1.

(Configuration of Humidifier)

Figure 17:
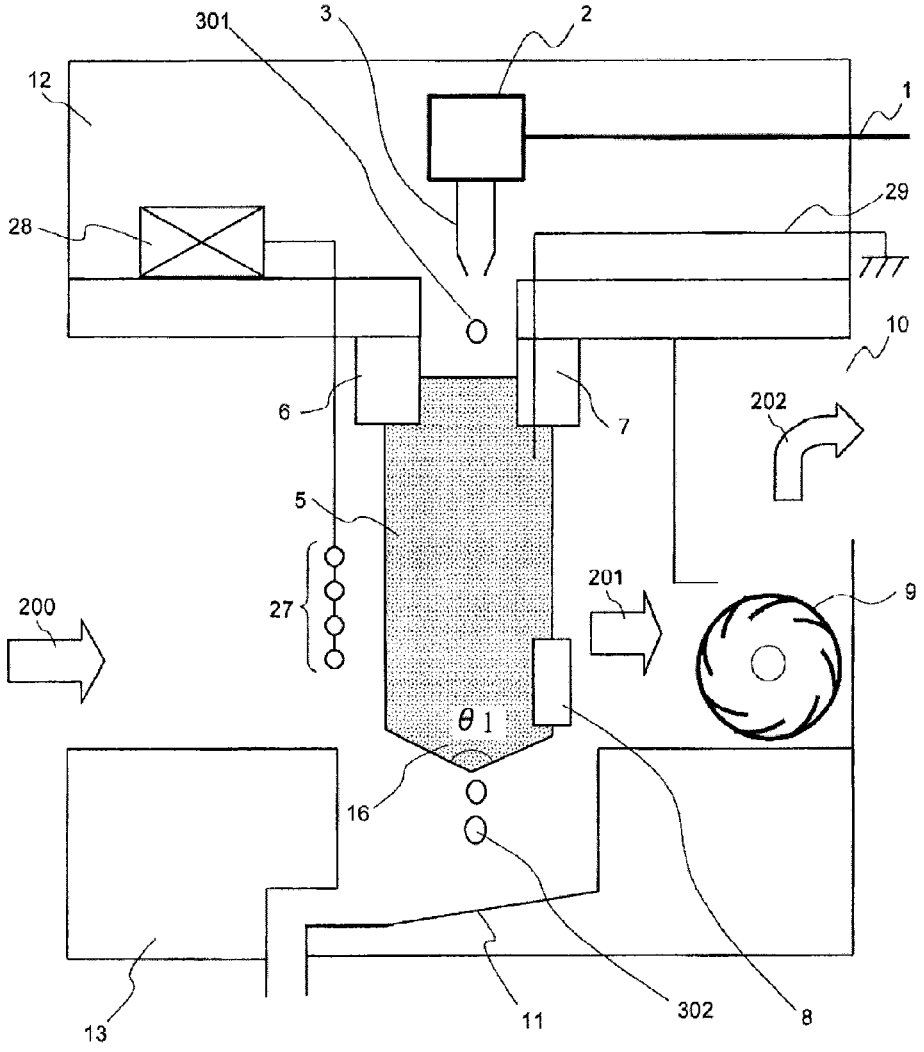
FIG. 17 is a drawing showing a configuration of a humidifier according to Embodiment 7 of the present invention.

FIG. 17 is a schematic side view showing a configuration of a humidifier according to Embodiment 7 of the present invention. As shown in FIG. 17, the humidifier according to Embodiment 7 further includes a conductor electrode 27 located upstream of the porous metal body 5 with a gap therefrom, and a power source 28 that applies a voltage to the conductor electrode 27, in addition to the configuration shown in FIG. 1. In addition, a ground line 29 is attached to the porous metal body 5.

The conductor electrode 27 serves to generate an electric field in the space (gap) between the conductor electrode 27 and the porous metal body 5. The conductor electrode 27 has to have conductivity in order to generate an electric field in the space between the conductor electrode 27 and the porous metal body 5, and hence it is preferable to employ a metal, a metal alloy, or a conductive resin to form the conductor electrode 27. In addition, it is preferable to employ a material having low electrical resistance to form the conductor electrode 27, such as aluminum, copper, or stainless steel from the viewpoint of versatility and processability, but a different material may also be employed. The size of the conductor electrode 27 is not specifically limited either, but may be adjusted according to the size of the humidifier to be manufactured.

The power source 28 is connected to the conductor electrode 27 to apply a voltage thereto. When the power source 28 applies a voltage to the conductor electrode 27, an electric field is generated in the space between the porous metal body 5 and the conductor electrode 27.

For the porous metal body 5 to perform the humidification, the porous metal body 5 may be connected to the ground line 29 and a DC voltage of negative polarity to the conductor electrode 27 opposed to the porous metal body 5 as shown in FIG. 17. Alternatively, though not illustrated, a DC voltage of positive polarity may be applied to the porous metal body 5 and the conductor electrode 27 opposed to the porous metal body 5 may be grounded. However, in the case where a DC voltage of positive polarity is applied to the porous metal body 5 containing water, the porous metal body 5 may be deteriorated owing to electrical corrosion, and therefore it is preferable to connect the porous metal body 5 to the ground line and apply a DC voltage of negative polarity to the conductor electrode 27 opposed to the porous metal body 5, as shown in FIG. 17.

Regarding the voltage value to be applied by the power source 28 to the conductor electrode 27, a range between −10 [kV] and −4 [kV] is preferable in the case of applying a DC voltage of negative polarity. When the applied voltage is higher than −4 [kV] and lower than 0 [kV], the intensity of the electric field generated between the porous metal body 5 and the conductor electrode 27 is insufficient, and water is unable to be drawn out from the porous metal body 5. On the other hand, when the applied voltage is lower than −10 [kV] (absolute value of the applied voltage is higher than 10 [kV]), the load of the power source 28 is increased and it becomes difficult to properly design the insulation.

Further, as will be described regarding the operation of the humidifier according to Embodiment 7, it is preferable to set the intensity of the electric field generated between the porous metal body 5 and the conductor electrode 27 to a level lower than 30 [kV/cm] which is the breakdown field intensity of gas, in order to suppress discharging in the humidifier. This is because when an electric field having an intensity of 30 [kV/cm] is generated between the porous metal body 5 and the conductor electrode 27 by the power source 28, spark discharge takes place between the porous metal body 5 and the conductor electrode 27, which leads to a shortened life span of the porous metal body 5 and an increase in useless power consumption arising from heat generation.

It is preferable that the gap length of the space between the porous metal body 5 and the conductor electrode 27 is in a range of 3 [mm] to 20 [mm]. When the gap length is shorter than 3 [mm], the pressure loss of the wind supplied by the fan increases because the space between the porous metal body 5 and the conductor electrode 27 is narrow and therefore the electrical load of the fan 9 is increased. In contrast, when the gap length is longer than 20 [mm], a field intensity sufficient for drawing the water out of the porous metal body 5 is unable to be obtained, and hence the humidification performance is degraded.

In addition, the porous metal body 5 according to Embodiment 7 includes, as in Embodiment 1, the tip portion 16 which is water-absorptive and protruding downward, on the bottom face of the porous metal body 5 serving as the ground electrode. In Embodiment 7, the tip portion 16 is located at a lower position than the conductor electrode 27.

The tip portion 16 may be formed in a desired shape provided that the water droplet 302 is facilitated to drop, and for example the shape illustrated in FIG. 7 and FIG. 8 may be adopted. Alternatively, the tip portion 16 may be provided at an end portion of the porous metal body 5 in the depth direction as shown in FIG. 9.

In addition, it is preferable to employ a water-absorptive material to form the tip portion 16, and the tip portion 16 may be formed of the same material as that of the porous metal body 5, or a material different from that of the porous metal body 5.

(Operation of Humidifier)

Still referring to FIG. 17, the operation of the humidifier according to Embodiment 7 will be described.

First, the humidifying operation of the humidifier will be described.

The water supplied through the supply pipe 1 is stored in the reservoir 2, and the water in the reservoir 2 is conveyed to the nozzle 3 as humidifying water. Upon reaching the nozzle 3, the humidifying water is dropped from above the porous metal body 5 to the top portion thereof, in the form of the water droplet 301. The humidifying water is thus supplied to the porous metal body 5. The humidifying water uniformly diffuses throughout the porous metal body 5 through the voids 15 owing to the capillary force of the porous metal body 5 and the gravity to the humidifying water, so that the porous metal body 5 retains a certain amount of water.

In this process, when the power source 28 applies a voltage to the conductor electrode 27 opposed to the porous metal body 5 with a predetermined gap therebetween, an electric field is generated between the porous metal body 5 which is grounded and the conductor electrode 27, and the electric charge migrates to the vicinity of the surface of the porous metal body 5. The water in the voids 15 of the porous metal body 5 are induction-charged by the electric charge that has migrated to the vicinity of the surface of the porous metal body 5, and the induction-charged water forms a Taylor cone of a triangular conical shape directed to the conductor electrode 27, owing to a Coulomb's force from the electric field. The Taylor cone is maintained in the triangular conical shape because of the balance between the Coulomb's force from the electric field applied to the induction-charged water and the surface tension. When the input voltage applied by the power source 28 to the conductor electrode 27 is increased so as to increase the field intensity until the Coulomb's force exceeds the surface tension of the water forming the Taylor cone, the Taylor cone drawn out from the porous metal body 5 is emitted to the space in a form of mist, and micronized into a size of scores of nanometers through Rayleigh fission. However, in Embodiment 7 the intensity of the electric field between the porous metal body 5 and the conductor electrode 27 is controlled by the power source 28 so as to prevent discharging, and therefore the water on the surface of the porous metal body 5 is maintained in the form of the Taylor cone.

The water in the surface layer of the porous metal body 5 and the Taylor cone drawn out of the porous metal body 5 by the electric field transpire through gas-liquid contact with gas to be processed, which is the air supplied by the fan 9 provided upstream or downstream of the humidification unit including the porous metal body 5 and the conductor electrode 27, thereby humidifying the space to be humidified. The direction in which the fan 9 supplies the gas to be processed is set to be perpendicular to the direction of the electric field generated in the space between the porous metal body 5 and the conductor electrode 27.

Further, increasing the voltage to be applied by the power source 28 to the conductor electrode 27 so as to increase the intensity of the electric field between the porous metal body 5 and the conductor electrode 27 facilitates the formation of the Taylor cone, and therefore the contact area between the Taylor cone and the gas to be processed increases, thereby improving the humidifying performance.

In the case where the amount of water transpiring from the porous metal body 5 is smaller than the amount of the humidifying water supplied from the reservoir 2, the surplus water unconsumed for the humidification and remaining in the porous metal body 5 is deposited in the tip portion 16 in the lower portion of the porous metal body 5 owing to the gravity, and then leaks out of the tip portion 16 and drops downward. The water that has leaked out of the tip portion 16 of the porous metal body 5 is received by the drain pan 11 and discharged to outside of the humidifier.

(Advantageous Effects of Embodiment 7)

In Embodiment 7, the electric field is generated between the porous metal body 5 and the conductor electrode 27, and the Taylor cone is drawn out of the porous metal body 5. Therefore, the humidification of the target space can be performed utilizing both the transpiration from the surface layer of the porous metal body 5 and the transpiration of the Taylor cone. Consequently, the humidifying performance can be improved.

In the case where the amount of water transpiring from the porous metal body 5 is smaller than the amount of the humidifying water supplied from the reservoir 2, the surplus water reaches the lower end portion of the porous metal body 5, and drops onto the drain pan 11 in the form of dews thus to be discharged. At this point, in the case where the spatial distance between the water droplet 302 and the conductor electrode 27 is too short, abnormal discharging may take place. In Embodiment 7, however, the tip portion 16 is provided in the lower end portion of the porous metal body 5, so that the surplus water drops from the tip portion 16 onto the drain pan 11 in the form of the water droplet 302. In addition, the conductor electrode 27 is located at an upper position with respect to the tip portion 16. Accordingly, a sufficient spatial distance can be secured between the water droplet 302 and the conductor electrode 27, and therefore the abnormal discharging between the water droplet 302 and the conductor electrode 27 can be suppressed.

In addition, the water in the lower end portion of the porous metal body 5 can be efficiently discharged through the tip portion 16, and therefore the growth of germs and mold in the porous metal body 5 can be suppressed, and the humidifying performance unchanged from the initial state can be maintained.

Although the humidifying member is constituted of the porous metal body 5 or the metal fiber 4 in Embodiments 1 to 7, a porous ceramic may be employed to form the humidifying member. In Embodiment 7 in particular, employing a conductive porous ceramic to form the humidifying member allows an electric field to be generated between the humidifying member and the conductor electrode 27.

In addition, the configurations represented by Embodiments 1 to 7 may be adopted in combination. In particular, the configuration of the porous metal body 5 and the tip portion 16 according to Embodiment 1 and Embodiment 2 may be applied to any of the other Embodiments.

Embodiment 8

A humidifier according to Embodiment 8 will be described hereunder, focusing on differences from Embodiment 1 and Embodiment 2.

(Configuration of Humidifier)

Figure 18:
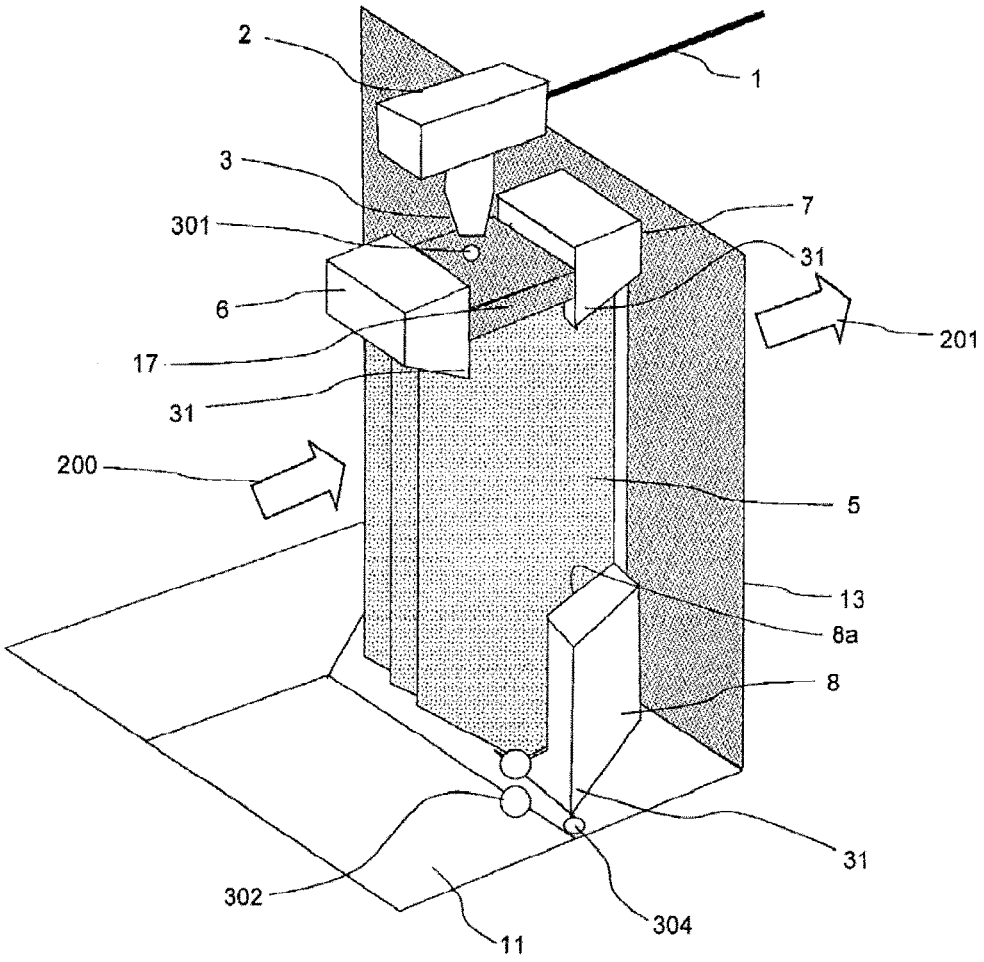
FIG. 18 is a perspective view showing an essential part of a humidifier according to Embodiment 8 of the present invention.
Figure 19:
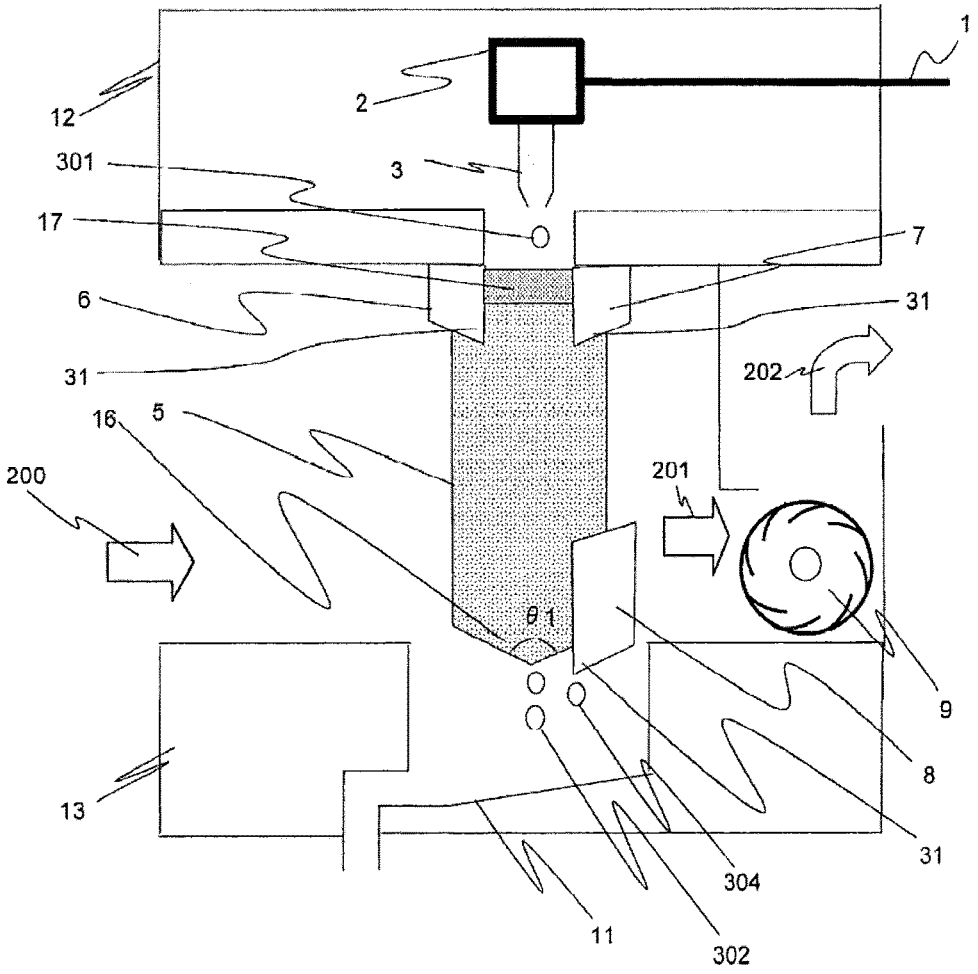
FIG. 19 is a drawing showing a configuration of the humidifier according to Embodiment 8 of the present invention.

FIG. 18 is a perspective view showing an essential part of the humidifier according to Embodiment 8 of the present invention. FIG. 19 is a schematic side cross-sectional view showing a configuration of the humidifier according to Embodiment 8 of the present invention.

Embodiment 8 is different from Embodiment 1 shown in FIG. 1 and Embodiment 2 shown in FIG. 9 in the shape of the lower end portion of the upper upstream support member 6, the upper downstream support member 7, and the lower support member 8. In Embodiments 1 and 2, the sides defining the respective bottom faces of the upper upstream support member 6, the upper downstream support member 7, and the lower support member 8 are all horizontal as shown in FIG. 1 or FIG. 9, and hence the bottom faces constitute horizontal surfaces. In contrast, in Embodiment 8 shown in FIG. 18 and FIG. 19, the respective bottom faces of the upper upstream support member 6, the upper downstream support member 7, and the lower support member 8 are inclined instead of horizontal. All the sides defining the respective bottom faces of the upper upstream support member 6, the upper downstream support member 7, and the lower support member 8 are linear, and therefore the respective bottom faces of the upper upstream support member 6, the upper downstream support member 7, and the lower support member 8 are flat inclined faces. Because of the bottom faces thus configured, the lower portion of each of the upper upstream support member 6, the upper downstream support member 7, and the lower support member 8 is smaller in horizontal cross-sectional area at a lower position than in an upper position, and the lower end portion of each of the upper upstream support member 6, the upper downstream support member 7, and the lower support member 8 is formed in a downwardly projecting shape. The mentioned projecting shape of the lower end portion of each of the upper upstream support member 6, the upper downstream support member 7, and the lower support member 8 will be referred to as tip portion 31.

Figure 20:
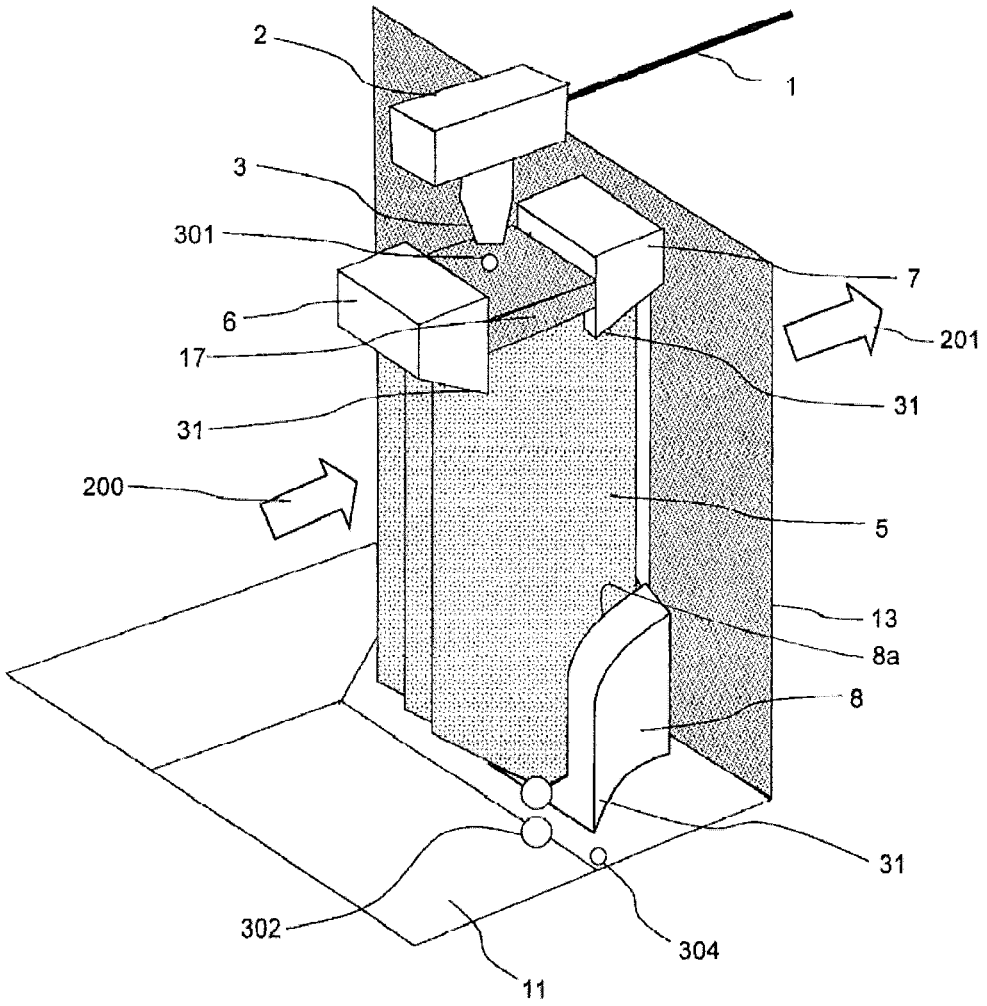
FIG. 20 is a perspective view showing an essential part of a humidifier according to Embodiment 9 of the present invention.

Referring further to FIG. 20, the top side 8*a* of the lower support member 8 disposed in contact with the porous metal body 5 is a linear side inclined upward in the direction from the upstream side toward the downstream side of the airflow. In addition, the top face of the lower support member 8 is inclined in the airflow direction and the direction orthogonal thereto.

Unlike the porous metal body 5, the upper upstream support member 6, the upper downstream support member 7, and the lower support member 8 do not have a porous structure, but are formed by molding from a resin or a metal. In the humidifying operation, the water migrates from the porous metal body 5 or the upper porous metal body 17 to the upper upstream support member 6, the upper downstream support member 7, and the lower support member 8, and propagates along the surface of these members. The water that has flowed along the surface of the upper upstream support member 6, the upper downstream support member 7, and the lower support member 8, which are formed of a resin or a metal, flows downward along the inclined bottom surface and then falls from the tip portion 31. The water that has migrated from the porous metal body 5 to the top face of the lower support member 8, and the water that has dropped from the upper downstream support member 7 onto the top face of the lower support member 8 flows along the inclined top side 8*a* and the top face of the lower support member 8.

In the example shown in FIG. 18 and FIG. 19, the bottom face of the upper upstream support member 6 is inclined downward in the direction from the upstream side toward the downstream side of the airflow, and the bottom face of the upper downstream support member 7 is inclined upward in the direction from the upstream side toward the downstream side of the airflow, and therefore the both bottom faces are inclined downward toward the porous metal body 5. Accordingly, the water that has flowed along the surface of the upper upstream support member 6 and the upper downstream support member 7 and dropped from the tip portion 31 is received by the drain pan 11 located under the porous metal body 5. In addition, the bottom face of the lower support member 8 is inclined upward in the direction from the upstream side toward the downstream side of the airflow, and therefore a water droplet 304 which has dropped from the tip portion 31 of the lower support member 8 is also received by the drain pan 11.

Regarding the porous metal body 5, the porous metal body 5 according to Embodiments 1 and 2 may be adopted, which includes the tip portion 16 formed such that the horizontal cross-sectional area of the lower portion thereof becomes smaller toward the lower position, stepwise or steplessly.

The humidifying operation and the drying operation of the humidifier are the same as those according to Embodiment 1.

(Advantageous Effects of Embodiment 8)

In Embodiment 8, the upper upstream support member 6, the upper downstream support member 7, and the lower support member 8 are not formed with a horizontal lower end portion, but formed such that the respective bottom faces are inclined, and the tip portion 31 is provided so as to protrude downward from the lower end portion of each of the inclined faces. Therefore, the water flowing along the upper upstream support member 6, the upper downstream support member 7, and the lower support member 8 concentrates in the tip portion 31 owing to the gravity, thus to be efficiently discharged. Efficiently discharging as above the water in the lower portion of the upper upstream support member 6, the upper downstream support member 7, and the lower support member 8 suppresses the growth of microbes such as germs and mold as well as the degradation in humidifying performance, thereby maintaining the humidifying performance unchanged from the initial state for a longer period of time.

In Embodiment 8, further, since the top side 8*a* of the lower support member 8 disposed in contact with the porous metal body 5 is inclined, the water that has migrated from the porous metal body 5 to the top portion of the lower support member 8 smoothly flows downward along the top side 8*a*, and therefore the water located on the lower support member 8 can be efficiently discharged. Efficiently discharging as above the water located on the lower support member 8 suppresses the growth of microbes such as germs and mold as well as the degradation in humidifying performance, thereby maintaining the humidifying performance unchanged from the initial state for a longer period of time. In addition, in Embodiment 8 the top face of the lower support member 8 is inclined both in the airflow direction and in the direction orthogonal thereto, and therefore the water located on the top face of the lower support member 8 can smoothly flow toward the lowest position of the top face (pointed portion). Still further, in Embodiment 8 the top face and the bottom face of the lower support member 8 are inclined at the same angle, and therefore the water located on the lower support member 8 is facilitated to concentrate in the tip portion 31. Consequently, the water located on the top face of the lower support member 8 can be efficiently discharged.

Alternatively, instead of forming all of the upper upstream support member 6, the upper downstream support member 7, and the lower support member 8 with the inclined bottom face so as to form the tip portion 31, only the bottom face of the lower support member 8, where the water flow is largest, may be inclined so as to form the tip portion 31.

Further, the shape of the tip portion 31 may be a pointed shape (triangular) like the tip portion 16 of the porous metal body 5 according to Embodiment 1, or a rectangular protrusion like the tip portion 16 shown in FIG. 7.

In addition, the inclination direction of the respective bottom faces of the upper upstream support member 6, the upper downstream support member 7, and the lower support member 8, and the inclination direction of the top side 8*a* and the top face of the lower support member 8 are not limited to those illustrated, and the mentioned faces may be inclined in either or both of the airflow direction and the direction orthogonal thereto.

Embodiment 9

A humidifier according to Embodiment 9 will be described hereunder, focusing on differences from Embodiment 8.

(Configuration of Humidifier)

Figure 21:
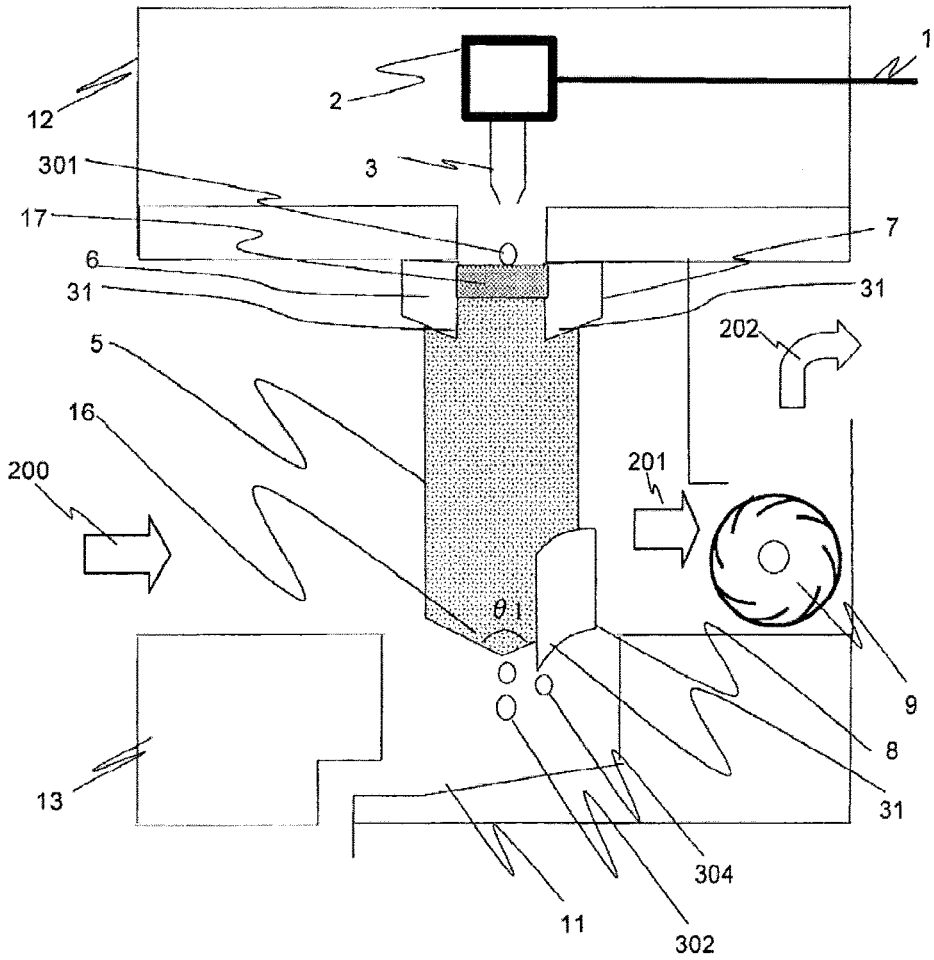
FIG. 21 is a drawing showing a configuration of the humidifier according to Embodiment 9 of the present invention.

FIG. 20 is a perspective view showing an essential part of a humidifier according to Embodiment 9 of the present invention. FIG. 21 is a schematic cross-sectional view showing a configuration of the humidifier according to Embodiment 9 of the present invention.

Embodiment 9 is different from Embodiment 8 in the shape of the lower and upper portion of the lower support member 8. In Embodiment 8, all of the sides defining the bottom face of the lower support member 8 are linear as shown in FIG. 18 and hence the bottom face of the lower support member 8 is a flat inclined face, but, the bottom face of the lower support member 8 according to Embodiment 9 is recessed upward so as to form an arcuately curved inclined face. As shown in FIG. 21, the sides defining the bottom face of the lower support member 8 are of an arcuate shape when viewed in a lateral direction. As shown in FIG. 20 and FIG. 21, the lower support member 8 includes the tip portion 31 formed in the lowermost portion in a shape of a downward projection.

In Embodiment 8, the top side 8*a* of the lower support member 8 disposed in contact with the porous metal body 5 is linear, and the top face of the lower support member 8 is a flat inclined face. In Embodiment 9, however, the top side 8*a* is arcuately curved and the top face of the lower support member 8 is an arcuately curved inclined face.

The humidifying operation and the drying operation of the humidifier are the same as those according to Embodiment 1.

(Advantageous Effects of Embodiment 9)

In Embodiment 9, the bottom face of the lower support member 8 is an arcuately curved inclined face, and the tip portion 31 of the projecting shape is provided in the lowermost portion of the lower support member 8. Accordingly, the water that has propagated from the porous metal body 5 to the lower support member 8 and flowed along the lower support member 8 concentrates in the tip portion 31 and drops in the form of the water droplet 304. Therefore, the water in the lower portion of the lower support member 8 can be efficiently discharged as in Embodiment 8. The mentioned configuration suppresses the growth of microbes such as germs and mold as well as the degradation in humidifying performance, thereby maintaining the humidifying performance unchanged from the initial state for a longer period of time.

In Embodiment 9, further, since the top side 8*a* of the lower support member 8 disposed in contact with the porous metal body 5 is inclined in the arcuate shape, the water that has propagated from the porous metal body 5 to the top portion of the lower support member 8 smoothly flows downward along the top side 8*a*, and therefore the water located on the lower support member 8 can be efficiently discharged. Efficiently discharging as above the water located on the lower support member 8 suppresses the growth of microbes such as germs and mold as well as the degradation in humidifying performance, thereby maintaining the humidifying performance unchanged from the initial state for a longer period of time. In addition, in Embodiment 9 the top face of the lower support member 8 is the arcuately curved inclined face, and therefore the water located on the top face of the lower support member 8 can smoothly flow toward the lowest position of the top face (pointed portion).

Here, the respective bottom faces of the upper upstream support member 6 and the upper downstream support member 7 may also be formed in a shape of arcuately curved inclined face, like the lower support member 8 according to Embodiment 9.

Figure 22:
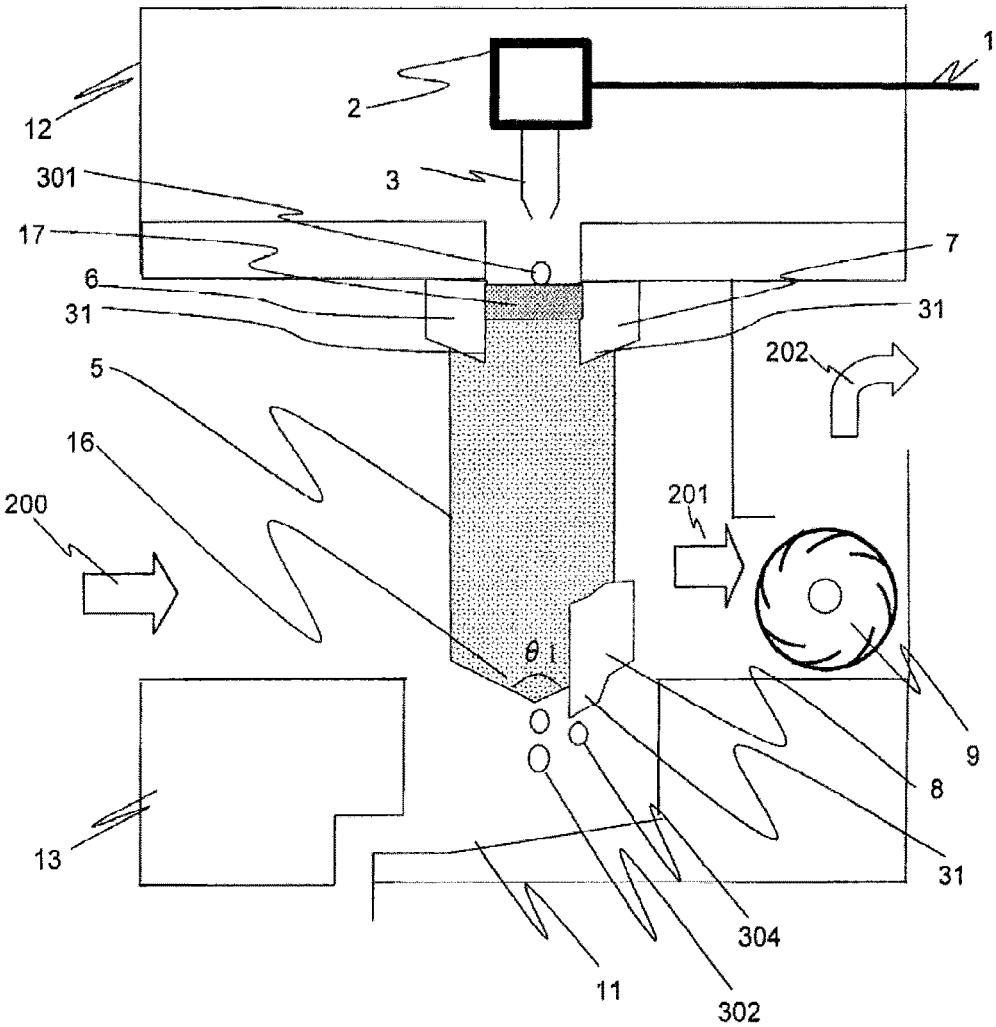
FIG. 22 is a side view showing a modification of a lower support member 8 according to Embodiment 9 of the present invention.

The shapes of the respective bottom faces of the upper upstream support member 6, the upper downstream support member 7, and the lower support member 8 are not limited to the flat inclined face of Embodiment 8, or the curved inclined face of Embodiment 9. FIG. 22 is a schematic side view showing a modification of the lower support member 8 according to Embodiment 9 of the present invention. In the example shown in FIG. 22, the bottom face of the lower support member 8 includes a plurality of flat faces serially formed, and the tip portion 31 protruding downward is provided in the lower end portion of the lower support member 8. Thus, the shape of the lower portion of the lower support member 8 is not specifically limited provided that a part of the lower portion is formed so as to protrude downward, though different from FIG. 22. This also applies to the respective top faces of the upper upstream support member 6 and the upper downstream support member 7, as well as the top face of the lower support member 8.

Embodiment 10

A humidifier according to Embodiment 10 will be described hereunder, focusing on differences from Embodiment 1.

Figure 23:
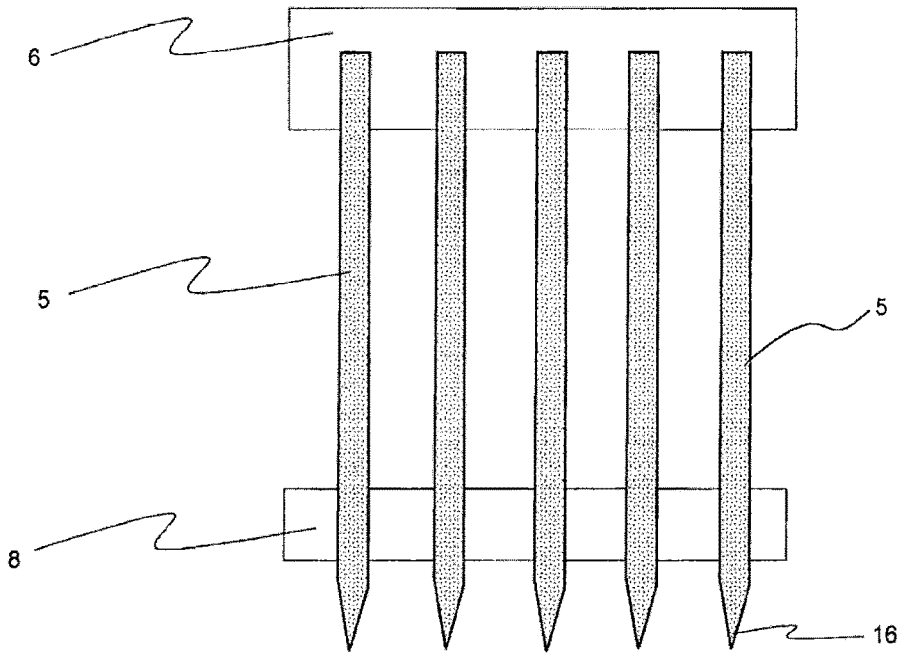
FIG. 23 is a drawing of the porous metal body 5 viewed from the upstream side of the humidifier according to Embodiment 10 of the present invention.

FIG. 23 is a drawing of the porous metal body 5 viewed from the upstream side of the humidifier according to Embodiment 10 of the present invention. FIG. 23 only illustrates the porous metal body 5, the upper upstream support member 6, and the lower support member 8. The humidifier according to Embodiment 10 includes a plurality of porous metal bodies 5 erected with a predetermined gap therebetween with the respective flat surfaces oriented generally parallel to each other. The porous metal bodies 5 shown in FIG. 23 each include the tip portion 16 formed in the lower end portion.

As shown in FIG. 23 the tip portion 16 of the porous metal body 5 according to Embodiment 10 has a tapered shape that is narrower at a lower position when viewed from the upstream side of the airflow, and the front cross-section of the porous metal body 5 has a generally pencil-like shape. Therefore, the tip portion 16 of the porous metal body 5 has a smaller horizontal cross-sectional area at a lower position than at an upper position.

Although the shape of the porous metal body 5 seen from a lateral direction may be rectangular as shown in FIG. 5, it is preferable to form the tip portion 16 of a protruding shape that is narrower at a lower position than at an upper position as shown in FIG. 1. In addition, the shape of such tip portion 16 may be a rectangular projection shown in FIG. 7, or a projection that is triangular in a view from a lateral direction shown in FIG. 9. Alternatively, the tip portion 16 may be formed by tilting the porous metal body 5 that is rectangular in a view from a lateral direction, as shown in FIG. 8.

The humidifying operation and the drying operation of the humidifier are the same as those according to Embodiment 1.

(Advantageous Effects of Embodiment 10)

As described above, in Embodiment 10 the porous metal body 5 includes the tip portion 16 protruding downward from the lower end portion, and the tip portion 16 is formed in a tapered shape that is narrower at a lower position when viewed from the upstream side of the airflow (front side). Accordingly, the surplus water in the porous metal body 5 is deposited in the tip portion 16 and leaks therefrom thus dropping downward, and therefore the water in the lower end portion can be efficiently discharged. The mentioned configuration suppresses the growth of germs and mold, thereby maintaining the humidifying performance unchanged from the initial state.

Embodiment 11

Embodiment 11 represents an air-conditioning apparatus including the humidifier, as described hereunder with reference to the drawing.

(Configuration of Humidifier)

Figure 24:
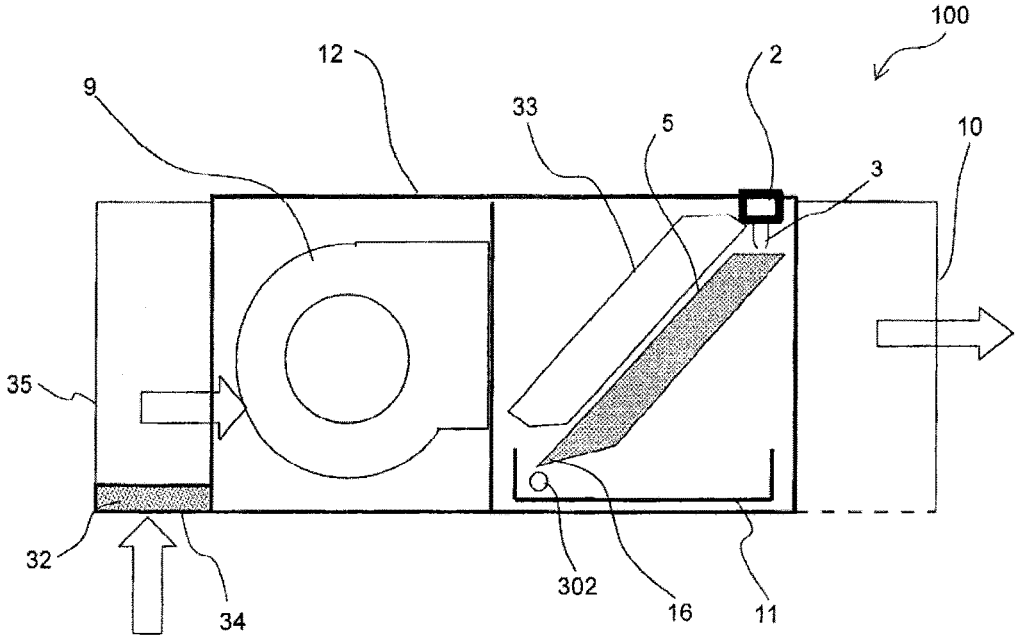
FIG. 24 is a drawing showing a configuration of an air-conditioning apparatus 100 according to Embodiment 11 of the present invention, including the humidifier.

FIG. 24 is a schematic drawing showing a configuration of an air-conditioning apparatus 100 according to Embodiment 11 of the present invention, including the humidifier. The air-conditioning apparatus 100 shown in FIG. 24 is configured to perform the humidifying operation by using the humidifier, and cooling or heating operation at the same time as or independent from the humidifying operation. Here, although the humidifier shown in FIG. 24 is different from the humidifier of Embodiments 1 to 10 in shape and arrangement of a part of the constituents, the constituents corresponding to those shown in Embodiments 1 to 10 are given the same numerasl.

As shown in FIG. 24, the humidifier is installed in a casing 35 constituting the outer shell of the air-conditioning apparatus 100. The casing 35 includes therein the reservoir 2, the nozzle 3, the porous metal body 5, the fan 9, and the drain pan 11. Although the fan 9 is located upstream of the porous metal body 5 in the example shown in FIG. 24, the fan 9 may be located downstream of the porous metal body 5 as in Embodiments 1 to 10. In the casing 35 of the air-conditioning apparatus 100, a heat exchanger 33 is provided between the fan 9 and the porous metal body 5. In addition, a filter 32 that captures dust is provided at an air inlet 34 through which air is introduced into the casing 35.

In the heat exchanger 33 a heated or cooled refrigerant flows for heat exchange between the air flowing around the heat exchanger 33 and the refrigerant. The heat exchanger 33 is opposed to the porous metal body 5, and hence the air supplied by the fan 9 flows into the porous metal body 5 after passing through the heat exchanger 33.

The porous metal body 5 has a generally diamond-like shape in a view from a lateral direction, formed along the outer shape of the heat exchanger 33 opposed to the porous metal body 5. The bottom face of the porous metal body 5 is inclined in an up-down direction, and the porous metal body 5 includes the tip portion 16 protruding downward from the lower end portion. The specific shape of the tip portion 16 is not limited to the example shown in FIG. 24, and a different shape may be adopted as illustrated in FIG. 1, FIG. 7, FIG. 8, FIG. 9, or FIG. 23. In addition, a plurality of plate-shaped porous metal bodies 5 are erected parallel to each other with a gap therebetween, and the humidifying water is supplied to the upper portion of each of the porous metal bodies 5 through the reservoir 2 and the nozzle 3, as the configuration according to Embodiment 1.

(Operation of Humidifier)

Referring to FIG. 24, the operation of the humidifier according to Embodiment 11 will be described hereunder.

The air-conditioning apparatus 100 according to Embodiment 11 including the humidifier is configured to perform the humidifying operation, as well as the heating and cooling operation. The air-conditioning apparatus 100 includes a non-illustrated sensor that detects either or both of temperature and humidity of air in the space to be air-conditioned, to perform the humidifying operation and the heating/cooling operation at the same time or selectively, according to the temperature or humidity of the air in the space to be air-conditioned.

The humidifying operation is performed in the same way as Embodiment 1, in which the water stored in the reservoir 2 is conveyed to the nozzle 3 to serve as the humidifying water. The humidifying water conveyed to the nozzle 3 is dropped from above the porous metal body 5 to the top portion thereof. The humidifying water is thus supplied to the porous metal body 5. The humidifying water uniformly diffuses throughout the porous metal body 5 through the voids 15 in the porous metal body 5 owing to the capillary force thereof and the gravity to the humidifying water, so that the porous metal body 5 retains a certain amount of water.

When the fan 9 is activated, air is sucked into the casing 35 through the air inlet 34, and passes through the porous metal body 5 after sequentially passing through the filter 32, the fan 9, and the heat exchanger 33, and then supplied to outside of the air-conditioning apparatus 100 (into the room) through the air outlet 10 of the casing 35. The water retained by the porous metal body 5 transpires through gas-liquid contact with the air being caused to flow by the fan 9, thereby humidifying the air.

The surplus water in the porous metal body 5 unconsumed for the humidification is deposited in the tip portion 16 in the lower end portion of the porous metal body 5 owing to gravity, and leaks out of the tip portion 16 and drops downward in the form of the water droplet 302. The water which has leaked out of the porous metal body 5 is received by the drain pan 11 and discharged to outside of the humidifier.

The humidified air can thus be supplied to the space to be humidified, by the mentioned humidifying operation of the humidifier.

Upon supplying the heated or cooled refrigerant to the heat exchanger 33 during the foregoing operation, heat exchange is performed between the refrigerant flowing in the heat exchanger 33 so as to change the temperature of the air. The heating or cooling of the air by the heat exchanger 33 and the evaporation of the water from the porous metal body 5 can create the desired temperature environment and humidity environment in the space to be air-conditioned.

The drying operation of the humidifier provided in the air-conditioning apparatus 100 is the same as Embodiment 1, in which the dripping of the water from the nozzle 3 is stopped after performing the humidifying operation for a predetermined time, and the fan 9 continues to blow air for a predetermined time. Performing thus the drying operation to dry the porous metal body 5 suppresses the growth of microbes such as germs and mold in the porous metal body 5. In the drying operation, the air sucked through the air inlet 34 may be supplied as it is to the porous metal body 5 without the refrigerant being supplied to the heat exchanger 33, or hot wind heated by the heated refrigerant supplied to the heat exchanger 33 may be supplied to the porous metal body 5.

(Advantageous Effects of Embodiment 11)

As described above, the air-conditioning apparatus 100 according to Embodiment 11 including the humidifier is configured to discharge the surplus water in the porous metal body 5 through the tip portion 16. Accordingly, dews are barely deposited in the lower end portion of the porous metal body 5, and therefore the growth of germs and mold can be suppressed.

REFERENCE SIGNS LIST

1: supply pipe, 2: reservoir, 3: nozzle, 4: metal fiber, 5: porous metal body, 6: upper upstream support member, 7: upper downstream support member, 8: lower support member, 8*a*: top side, 9: fan, 10: air outlet, 11: drain pan, 12: casing, 13: casing, 14: metal portion, 15: void, 16: tip portion, 17: upper porous metal body, 18: heater, 19: heat transfer fin, 20: damper, 21: sensor, 22: LED, 23: photomultiplier, 24: power source, 25: amplifier circuit, 26: determination device, 27: conductor electrode, 28: power source, 29: ground line, 31: tip portion, 32: filter, 33: heat exchanger, 34: air inlet, 35: casing, 100: air-conditioning apparatus, 200: arrow, 201: arrow, 202: arrow, 301: dew, 302: dew, 303: bridge, 304: dew

The invention claimed is:

1. A humidifier comprising:

a plurality of humidifying members constituted of a foamed metal, having a flat plate shape and having a surface subjected to a hydrophilic treatment, and opposed to each other with a gap therebetween;

a water-supplying device that supplies water to the plurality of humidifying members;

a blower device that draws air which passes horizontally through the plurality of humidifying members outside the humidifier; and a projecting portion comprising a projection or a corner, the projection or the corner projecting along a direction in which air is caused to flow in each of the plurality of humidifying members, the projection or the corner being formed on a lower end portion of each of the plurality of humidifying members, wherein the airflow is preferentially supplied to the projecting portion of each of the plurality of humidifying members in a drying operation in which the water-supplying device does not supply the water to each of the plurality of humidifying members and the blower device causes air to flow to each of the plurality of humidifying members, in comparison to a portion of each of the plurality of humidifying members other than the projecting portion, wherein each of the humidifying members is vertically erected and configured such that a thickness of each of the humidifying members becomes smaller from an upper position of each of the humidifying members toward a lower position of each of the humidifying members stepwise or steplessly, and a gap is provided between the water-supplying device and the plurality of humidifying members, and wherein the humidifier is configured to selectively perform a humidifying operation in which the water-supplying device supplies the water to each of the plurality of humidifying members and the blower device causes air to flow to each of the plurality of humidifying members.

2. The humidifier of claim 1, wherein a projecting portion comprising a projection or a corner is formed on a lower end portion of each of the plurality of humidifying members, the projecting portion projecting along a direction in which air is caused to flow in the plurality of humidifying members.

3. The humidifier of claim 2, wherein the projecting portion is provided in an upstream region of each of the plurality of humidifying members in a direction in which the air is caused to flow.

4. The humidifier of claim 1, further comprising:

an upper humidifying member having therein a plurality of voids and disposed to cover a top portion of the plurality of humidifying members, wherein the water from the water-supplying device is supplied to the plurality of humidifying members through the upper humidifying member.

5. The humidifier of claim 1, further comprising:

a humidifying member supporter having a heat conductance equal to or higher than a heat conductance of each of the plurality of humidifying members, and supporting each of the plurality of humidifying members with respect to a casing, Wherein the plurality of humidifying members and the humidifying member supporter, as well as the humidifying member supporter and the casing are tightly joined.

6. The humidifier of claim 5, wherein a lower face of the humidifying member supporter is inclined.

7. The humidifier of claim 1, further comprising:

a heating device that heats each of the plurality of humidifying members, or a heat transfer device that transfers heat transmitted from each of the plurality of humidifying members.

8. The humidifier of claim 1, wherein airflow of a higher velocity is supplied to each of the plurality of humidifying members in the drying operation than in the humidifying operation.

9. A humidifier comprising:

a plurality of humidifying members constituted of a foamed metal, having a flat plate shape and having a surface subjected to a hydrophilic treatment, and opposed to each other with a gap therebetween;

a water-supplying device that supplies water to the plurality of humidifying members;

a blower device that draws air which passes horizontally through the plurality of humidifying members outside the humidifier;

wherein each of the humidifying members is vertically erected and configured such that a thickness of each of the humidifying members becomes smaller from an upper position of each of the humidifying members toward a lower position of each of the humidifying members stepwise or steplessly, and a gap is provided between the water-supplying device and the plurality of humidifying members;

a conductor electrode opposed to each of the plurality of humidifying members with a gap therebetween; and a power source that applies a voltage between each of the plurality of humidifying members and the conductor electrode.

* * * * *